US008371864B2

(12) United States Patent
Kang et al.

(10) Patent No.: US 8,371,864 B2
(45) Date of Patent: Feb. 12, 2013

(54) GROUNDING UNIT FOR HIGH-FREQUENCY CONNECTOR AND HIGH-FREQUENCY CONNECTOR MODULE HAVING THE SAME

(75) Inventors: Kyoung il Kang, Gyeonggi-do (KR); Yong Goo Lee, Seoul (KR); Jang Mook Lee, Chungcheongnam-do (KR); Dong-il Lim, Gyeonggi-do (KR)

(73) Assignee: Gigalane Co. Ltd., Gyeonggi-do (KR)

( * ) Notice: Subject to any disclaimer, the term of this patent is extended or adjusted under 35 U.S.C. 154(b) by 35 days.

(21) Appl. No.: 13/109,191

(22) Filed: May 17, 2011

(65) Prior Publication Data

US 2012/0295455 A1 Nov. 22, 2012

(51) Int. Cl.
*H01R 12/00* (2006.01)

(52) U.S. Cl. ..... 439/108

(58) Field of Classification Search ..... 439/63, 439/65, 108, 64, 79, 83, 581
See application file for complete search history.

(56) References Cited

U.S. PATENT DOCUMENTS

| | | | | |
|---|---|---|---|---|
| 3,539,966 | A * | 11/1970 | Logan | 439/63 |
| 3,553,607 | A * | 1/1971 | Lehrfeld | 33/34 |
| 5,215,470 | A * | 6/1993 | Henry et al. | 439/63 |
| 5,405,267 | A * | 4/1995 | Koegel et al. | 439/79 |
| 5,478,258 | A * | 12/1995 | Wang | 439/581 |
| 5,532,659 | A * | 7/1996 | Dodart | 333/260 |
| 5,897,384 | A * | 4/1999 | Hosler, Sr. | 439/63 |
| 6,296,492 | B1 * | 10/2001 | Fujimoto et al. | 439/63 |
| 6,468,089 | B1 * | 10/2002 | Hubbard et al. | 439/63 |
| 6,783,374 | B2 * | 8/2004 | Uratani et al. | 439/83 |
| 6,811,405 | B1 * | 11/2004 | Huang | 439/63 |
| 7,168,990 | B2 * | 1/2007 | Suzuki et al. | 439/636 |
| 7,607,922 | B2 * | 10/2009 | Kerekes et al. | 439/63 |
| 7,713,067 | B1 * | 5/2010 | Behrent | 439/63 |
| 7,731,512 | B1 * | 6/2010 | Montena et al. | 439/108 |
| 7,887,376 | B1 * | 2/2011 | Zhang et al. | 439/668 |
| 7,946,854 | B2 * | 5/2011 | Weidner et al. | 439/63 |
| 7,980,893 | B2 * | 7/2011 | Sato et al. | 439/578 |
| 2003/0186565 | A1 * | 10/2003 | Kerekes et al. | 439/63 |
| 2008/0102654 | A1 * | 5/2008 | Kari | 439/63 |

FOREIGN PATENT DOCUMENTS

| | | |
|---|---|---|
| KR | 20-0121427 | 4/1998 |
| KR | 20-2000-0017121 | 9/2000 |

* cited by examiner

*Primary Examiner* — Alexander Gilman
(74) *Attorney, Agent, or Firm* — Harness, Dickey & Pierce, P.L.C.; Anthony G. Fussner; Kisuk Lee

(57) ABSTRACT

A grounding unit for a high-frequency connector is provided, wherein the grounding unit may include a grounding unit body configured to be selectively fixed to the high-frequency connector; and a grounding fixation unit configured to be connected to the grounding unit body, to be in pressure contact with a grounding region of a printed circuit board (PCB) under elastic force applied in proportion to a thickness of the PCB, and to electrically connect the high-frequency connector to the grounding region.

7 Claims, 19 Drawing Sheets

GROUNDING UNIT FOR HIGH-FREQUENCY CONNECTOR AND HIGH-FREQUENCY CONNECTOR MODULE HAVING THE SAME

FIELD

The following disclosure generally relates to a high-frequency connector module. More particularly, this disclosure relates to a grounding unit for a high-frequency connector and a high-frequency connector module employing the grounding unit, which realizes a stable ground state and stable soldering by allowing a grounding region of a printed circuit board (PCB) to be fixed in close contact with a grounding rod of the high-frequency connector.

BACKGROUND

This section provides background information related to the present disclosure which is not necessarily prior art.

Generally, a wireless communication device such as a mobile phone has a printed circuit board (PCB) which includes a plurality of electronic parts for conducting individual functions. Such a PCB typically further includes a wireless communication module for wireless communication with another wireless communication device.

A wireless communication module includes a high-frequency antenna unit, which is generally connected to a connector to be grounded to a grounding pattern formed on the PCB.

A conventional method of fixing a high-frequency connector to a PCB is described below.

A general high-frequency connector has one end on which a connection unit having a device such as a high-frequency antenna connected thereto is formed and the other end on which a grounding terminal unit of a certain length that is accessible to a grounding pattern on an edge of a PCB is formed. In this case, the grounding terminal unit is generally in the shape of a rod of a predefined length. In addition, the grounding terminal unit may be composed of a plurality of rods.

The grounding terminal unit may be in physical contact with the grounding pattern on the PCB, and be soldered to the contact area by a solder material.

Thus, the bearing capacity or soldering force of the grounding terminal unit of the conventional PCB is dependent on the solder material because the grounding terminal unit is in direct contact with the grounding pattern on the PCB.

Hence, if an external impact is applied to the grounding terminal unit, a crack occurs on the soldered portion between the grounding terminal unit and the PCB, and as a result, the grounding terminal unit may be problematically moved aside or dislocated from the pattern of the PCB.

Further, since only the grounding terminal unit is soldered to the PCB, the mechanical stability cannot be ensured.

Thus, when a problematic event such as a crack occurs on a soldered portion, mechanical instability between the grounding terminal unit and the grounding pattern may increase, and accordingly the electrical stability may deteriorate since the conventional high-frequency connector increases fixation power by soldering on the PCB.

Furthermore, in an assembling procedure in which locations of the PCB and the high-frequency connector to be fixed are decided, since there is no additional apparatus for closely fixing the high-frequency connector to an edge of the PCB, manufacturing time is increased.

Specifically, when the PCB is inserted between grounding rods which are spaced apart from each other farther than a thickness of the PCB, the rods are not fixed but movable in respect of the edge of the PCB while the soldering process is performed. Therefore, during the soldering process, the connector may be dislocated, or one manufacturer needs to hold the connector and the PCB with both hands when another manufacturer solders the connector and the PCB, and as a result, the manufacturing process is inconvenient and soldering time is lengthened.

Moreover, a conventional high-frequency connector cannot be selectively fixed to a PCB which varies in thickness.

That is, due to such various thicknesses of PCB's, connectors for different distances between rods have been required. Therefore, it is required to develop a connector which can be fixed to an edge of a PCB before soldering, regardless of a thickness of a PCB, is easy to be soldered, and is applicable to PCBs of various thicknesses.

SUMMARY

This section provides a general summary of the disclosure and is not a comprehensive disclosure of its full scope or all of its features.

The present disclosure provides a grounding unit for a high-frequency connector and a high-frequency connector module including the grounding unit, wherein the grounding unit can realize a stable ground state and stable soldering by allowing a grounding region of a printed circuit board (PCB) to be fixed in close contact with a grounding rod of the high-frequency connector.

In an embodiment, the present disclosure provides a grounding unit for a high-frequency connector and a high-frequency connector module employing the grounding unit, wherein the grounding unit supports a printed circuit board (PCB) which varies in thickness and thus allows a grounding region of the PCB to be fixed in close contact with a grounding rod of the high-frequency connector.

In another embodiment, the present disclosure provides a grounding unit for a high-frequency connector and a high-frequency connector module employing the grounding unit, wherein the grounding unit guides a grounding rod of the high-frequency connector to be in surface contact with a grounding region of a printed circuit board (PCB) and maintains electrical conductivity and mechanical connectivity stable by allowing the grounding rod and the grounding region of the PCB to be soldered by a soldering material.

In one general aspect, there is provided a grounding unit for a high-frequency connector.

The grounding unit may include a grounding unit body configured to be selectively fixed to the high-frequency connector; and a grounding fixation unit configured to be connected to the grounding unit body, to have a predefined width, to be in pressure contact with a grounding region of a printed circuit board (PCB) by applying to the grounding region a predefined amount of elastic force corresponding to a thickness of the PCB, and to electrically connect the high-frequency connector and the grounding region.

The grounding unit body may further comprise an engagement body configured to be engaged with at least one grounding rod, each extending from the high-frequency connector, and thereby to be in electrical contact with the grounding rod, and a pair of exposure holes formed on both sides of the engagement body to expose the grounding rod to the outside.

The engagement body may have an upper portion divided into two segments in a longitudinal direction to be separatable from each other. The divided structure may enable flexible engagement.

The grounding fixation unit may further comprise a first fixation body configured to extend downward for a predefined length from a lower end of the engagement body, a second fixation body configured to be bent from the first fixation body and extend upward at a certain angle along the lower portion of the engagement body while maintaining a predefined distance from the lower surface of the engagement body, and a third fixation body configured to be curved from an end of the second fixation body toward the lower surface of the engagement body, have an end to be spaced apart from the lower surface of the engagement body and apply a predefined amount of elastic force to the PCB to be in contact with the lower surface of the engagement body.

When an upper grounding region is present on an upper surface of the PCB, the upper grounding region may be in contact with the lower surface of the engagement body and a lower grounding region formed on a lower surface of the PCB may be in contact with a top surface of the third fixation body.

The first fixation body may be configured to extend in a manner that forms an obtuse angle with the lower surface of the engagement body.

The high-frequency connector may further comprise a connector body on which one or a plurality of the grounding rods are provided and which further comprises a space portion in which the first fixation body can freely move at a predefined range.

The grounding unit body may be further configured to be fixed to enclose outer edges of the connector body of the high-frequency connector having a pair of the grounding rods, each extending for a predefined length.

The connector body may be further configured to be formed in a rectangular shape having four outer edges with a predefined thickness, and an upper portion of the grounding unit body can be separated into two segments detachable from each other.

A pair of the grounding fixation units may be provided in a manner that protrude from both lower sides of the grounding unit body which is located at a lower portion of a pair of the grounding rods, each of the grounding fixation units may be configured to comprise a first fixation body configured to protrude for a predefined length from each lower side of the grounding unit body and a second fixation body configured to extend stepwise from an end of the first fixation body, to be curved toward a lower portion of the grounding rod, and to apply a predefined amount of elastic force to the PCB such that the PCB which is led into the lower portion of a pair of the grounding rods can be in contact with lower surfaces of a pair of the grounding rod.

When an upper grounding region is present on an upper surface of the PCB, the upper grounding region may be in contact with lower surfaces of a pair of the grounding rods, and a lower grounding region formed on a lower surface of the PCB may be in contact with a top surface of the second fixation body.

The second fixation body may be configured to have an end protruding longer than a pair of the grounding rods by a predefined length.

The high-frequency connector may further comprise a connector body configured to comprise a pair of grounding rods extending for a predefined length, and the grounding unit body may be configured to have a predefined length and to have both ends enclosing the connector body in a manner that face each other in a lower portion of a pair of the grounding rods.

The grounding fixation unit may further comprise a first fixation body configured to be bent in a shape of ⌐ (which is a shape having a horizontal portion and a vertical portion extending from an end of the horizontal portion downward) from each upper side of the grounding unit body located at a lower portion of a pair of the grounding rods, such that the PCB led into the lower portion of the grounding rods can be in contact with lower surfaces of the grounding rods and a second fixation body configured to be tilted downward from an end of the first fixation body.

The high-frequency connector may further comprise a pair of first grounding rods extending for a predefined length and a pair of second grounding rods configured to be disposed to maintain a constant gap from lower ends of a pair of the first grounding rods, and the grounding unit body may be further configured to have a predefined length and to be installed on each of the second grounding rods in a manner that is in close contact with a top surface and a lower surface of the second grounding rod.

The grounding fixation unit may further comprise a first fixation body configured to extend from an end of the grounding unit body located at an upper portion of each second grounding rod and to be bent in a V shape, and a second fixation body configured to extend at a downward angle from an end of the first fixation body, and the PCB to be led into a lower portion of a pair of the first grounding rods may be elastically supported by a connect portion connecting the first fixation body and the second fixation body.

The high-frequency connector may further comprise a connector body configured to comprise a pair of first grounding rods extending for a predefined length, and a pair of second grounding rods configured to be disposed to maintain a constant gap from lower ends of a pair of the first grounding rods, and the grounding unit body configured to have a predefined length, to be installed in a manner that is in close contact with both sides of the connector body, and to have both ends, one being in contact with an upper portion of the connector body and the other being in contact with an inner wall of the gap.

The grounding fixation unit may further comprise a first fixation body configured to extend from an end of the grounding unit body located at the lower portion of each of the first grounding rods and to be bent in a V shape, and a second fixation body configured to extend at a downward angle from an end of the first fixation unit, and the PCB to be led into a lower portion of a pair of the first grounding rods may be elastically supported by a connect portion connecting the first fixation body and the second fixation body.

The grounding unit body may further comprise a pair of engagement bodies configured to be fixedly engaged with the respective first grounding rods that protrude from both lower sides of the high-frequency connector, and a connection body configured to connect an upper portion of a pair of the engagement bodies.

A pair of the engagement bodies may have inner side walls facing and open to each other.

The grounding fixation unit may further comprise a first fixation body configured to be bent upward from each front end of the connection body, a second fixation body configured to extend for a predefined length at an upward angle from an end of the first fixation body and to be placed on an upper portion of the first grounding rod while being spaced apart at a predefined distance from a lower surface of the second grounding rod, and a soldering body configured to extend at an upward angle from a rear end of the connection body while the inclination direction of the soldering body crosses the inclination direction of the second fixation body and to have a plurality of through-holes.

When an upper grounding region is present on an upper surface of the PCB, the upper grounding region may be in contact with lower surfaces of a pair of the second grounding rods and a lower grounding region which is formed on a lower surface of the PCB may be in contact with a top surface of the second fixation body and a top surface of the soldering body, and the through-holes of the soldering body may be configured to expose the lower grounding region to the outside.

The soldering body may further comprise a first soldering body configured to extend vertically from a top end of the connection body, a second soldering body configured to extend at an upward angle from an end of the first soldering body, while the inclination direction crosses the inclination direction of the second fixation body, and to include the through-holes formed thereon, and a third soldering body configured to extend at a downward angle from an end of the second soldering body, and the lower grounding region is in contact with the top surface of the second soldering body.

A pair of the engagement bodies may be configured to open a lower surface and either an inner or an outer side surface of each first grounding rod to the outside.

The grounding fixation unit may further comprise a first fixation body configured to linearly extend from both upper portions of a pair of the engagement bodies, a second fixation body configured to extend for a predefined length and at an upward angle from an end of the first fixation body in a manner that is spaced apart from a lower surface of the first grounding rod, and a third fixation body configured to extend from an end of the second fixation body at a downward angle along an opposite direction of the extension direction of the first fixation body. The lower grounding region formed on the PCB may be in contact with a top surface of the third fixation body.

In another general aspect, there is provided a high-frequency connector module.

The high-frequency connector may comprise: a high-frequency connector as described above, a connection unit configured to be formed on the high-frequency connector, and to be electrically connected to a high-frequency module; and a grounding unit for a high-frequency connector as described above.

Thus, the grounding unit can realize a stable ground state, and perform soldering stably and safely by allowing the grounding region of the PCB to be fixed in close contact with the grounding rod of the high-frequency connector.

In addition, the grounding unit has a structure which provides an elastic force to the grounding rod and thus can be connected to various PCBs of different thicknesses, and accordingly, the grounding region of the PCB can be fixed in close contact with the grounding rod of the high-frequency connector.

Furthermore, the grounding rod of the high-frequency connector can be guided to be in surface contact with the grounding region of the PCB, and at the same time, electrical conductivity and mechanical connectivity can be maintained stable by allowing the grounding rod and the grounding region of the PCB to be soldered by a soldering material.

Other features and aspects may be apparent from the following detailed description, the drawings, and the claims.

DRAWINGS

The drawings described herein are for illustrative purposes only of selected embodiments and not all possible implementations, and are not intended to limit the scope of the present disclosure.

Figure 1:
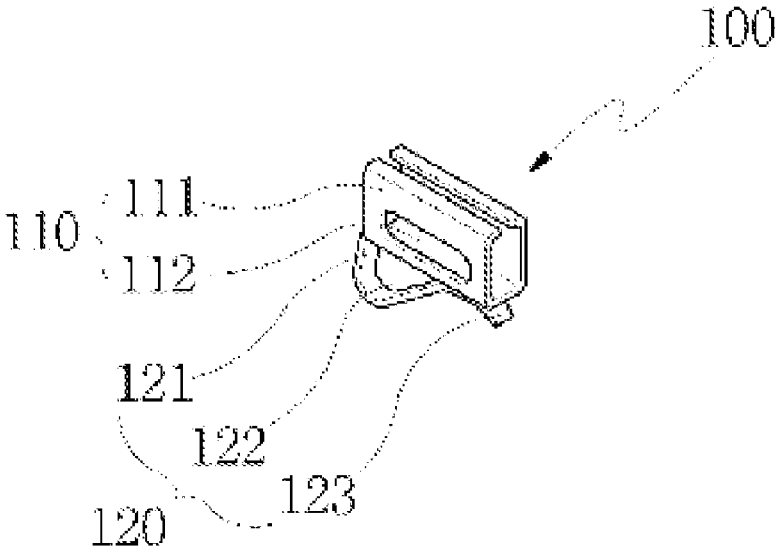
FIG. 1 is a perspective view of a grounding unit for a high-frequency connector according to Embodiment 1 of the present disclosure.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The present disclosure will now be described in detail with reference to the accompanying drawings. Descriptions of well-known functions and constructions may be omitted for clarity and conciseness.

Figure 3:
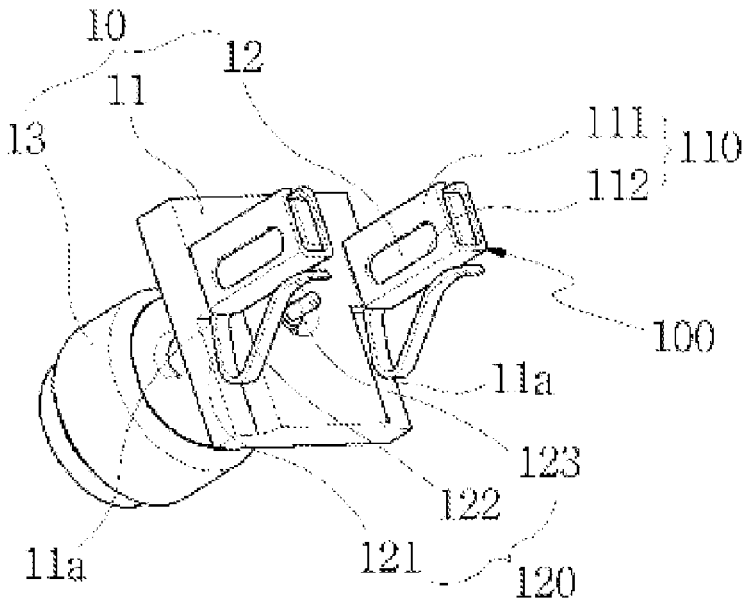
FIG. 3 is a perspective view of a high-frequency connector module having the grounding unit shown in FIG. 1.

Referring to an example illustrated in FIG. 3, a high-frequency connector module includes a high frequency connector 10, a connection unit 13 protruding from the high-frequency connector 10, and a grounding unit to connect grounding regions 51 and 52 of a printed circuit board (PCB) 50.

The connection unit 13 which is connected to an external high-frequency module (not illustrated) may be screw-connected to the external high-frequency module.

In addition, the connection unit 13 may have a pin hole (not illustrated) inside, and the high-frequency module may include a pin that is inserted into the pin hole and electrically connected to the high-frequency connector 10. Here, the high-frequency module may be an antenna which can be provided to a mobile communication device such as a mobile phone.

Exemplary embodiments of the grounding unit for a high-frequency connector will be described hereafter.

Embodiment 1

Figure 2:
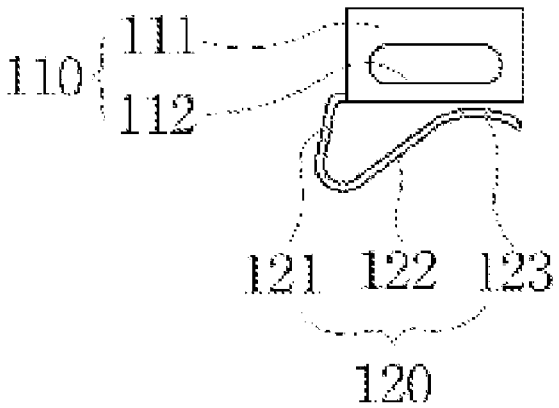
FIG. 2 is a side view of the grounding unit illustrated in FIG. 1.
Figure 4:
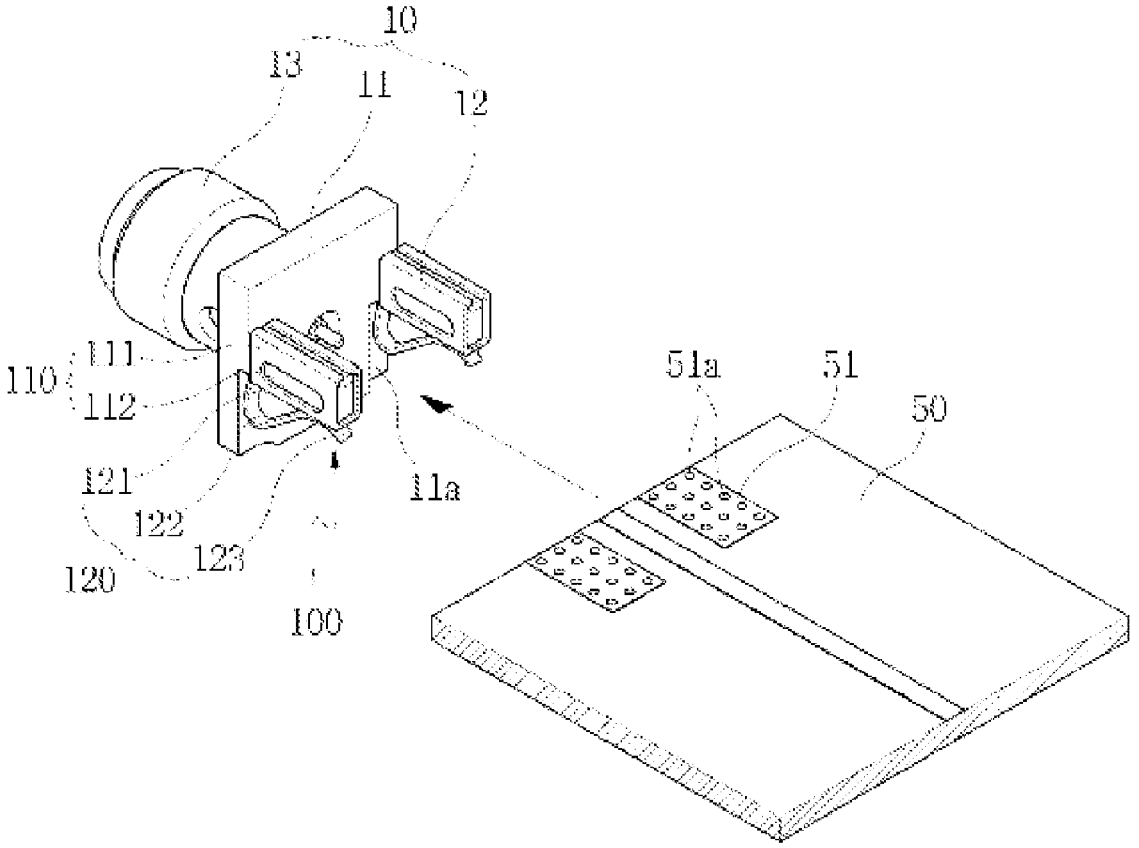
FIG. 4 is a perspective view of the high-frequency connector module having the grounding unit shown in FIG. 1.
Figure 5:
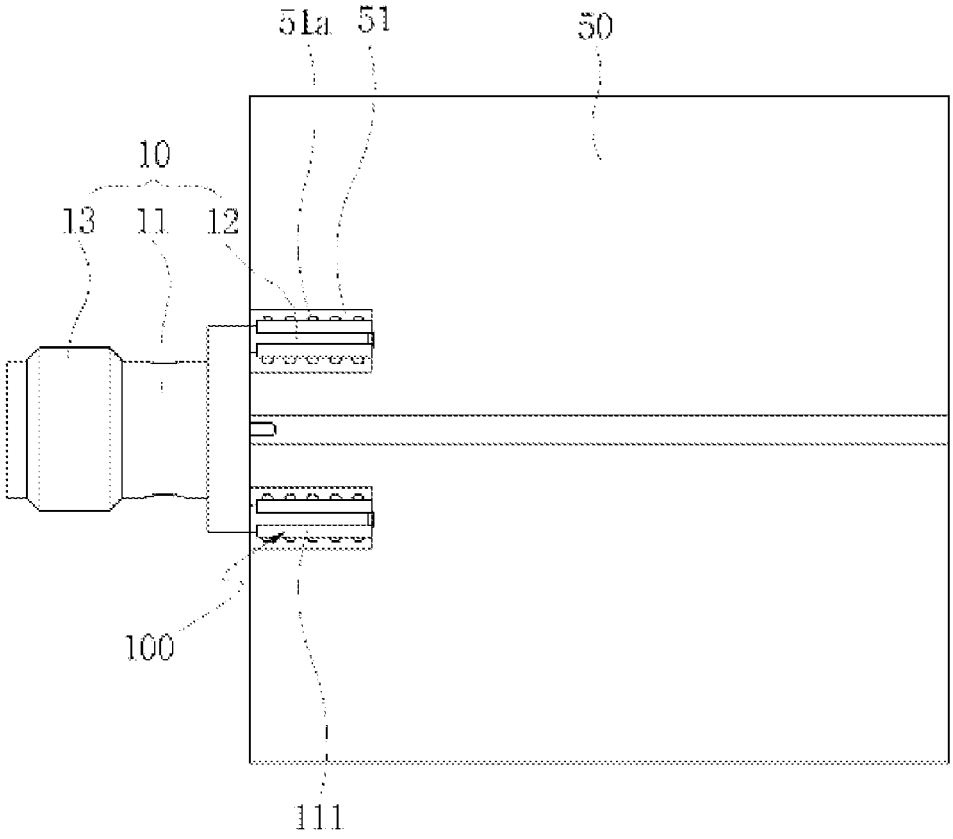
FIG. 5 is a plan view of the high-frequency connector module shown in FIG. 3.
Figure 6:
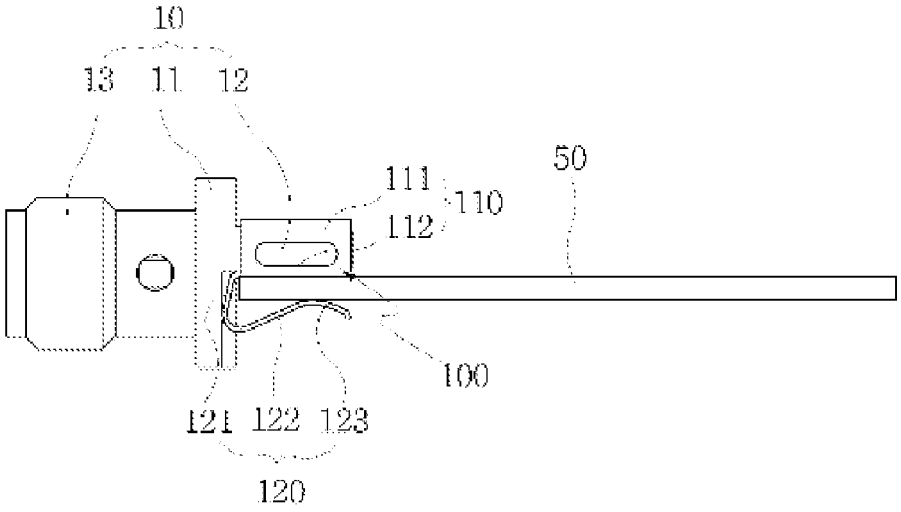
FIG. 6 illustrates a side view of the high-frequency connector module shown in FIG. 3.
Figure 7:
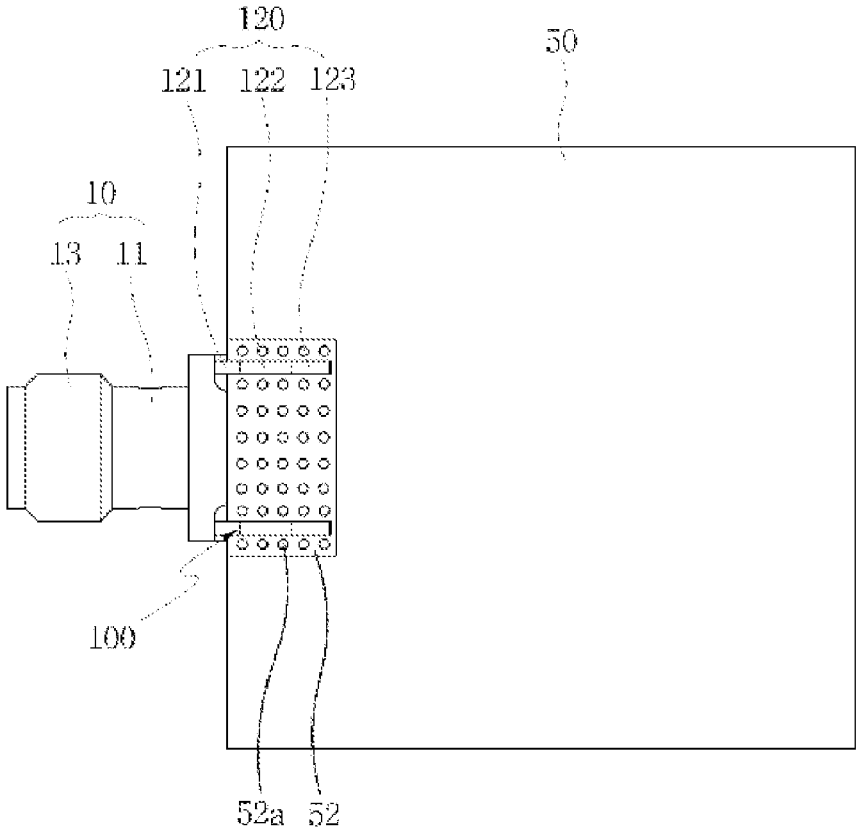
FIG. 7 illustrates a bottom view of the high-frequency connector module shown in FIG. 3.

FIG. 1 illustrates a perspective view of a grounding unit for a high-frequency connector according to Embodiment 1 of the present disclosure. FIG. 2 illustrates a side view of the grounding unit illustrated in FIG. 1. FIG. 3 illustrates a perspective view of a high-frequency connector module having the grounding unit which is illustrated in FIG. 1. FIG. 4 illustrates a perspective view of the high-frequency connector module having the grounding unit which is illustrated in FIG. 1. FIG. 5 illustrates a plan view of the high-frequency connector module which is illustrated in FIG. 3. FIG. 6 illustrates a side view of the high-frequency connector module which is illustrated in FIG. 3. FIG. 7 illustrates a bottom view of the high-frequency connector module which is illustrated in FIG. 3.

In Embodiment 1, the high-frequency connector 10 employing the grounding unit 100 may include a pair of grounding rods 12.

Specifically, referring to FIGS. 3 and 4, the high-frequency connector 10 may include a connector body 11 in the form of a rectangular plane and a pair of the grounding rods 12 which protrude from one side of the connector body 11 with a distance from each other, and the high-frequency connector 10 may have a connection unit 13 protruding from the other side of the high-frequency connector 10.

In this case, each of the grounding rods 12 may be in the form of a bar with a specific length and a rectangular cross section. Here, the cross section is not limited to a rectangle, and may be circular or triangular. The high-frequency connector 10 may be formed of a conductive material. Additionally, a pair of the grounding rods 12 may be positioned between a top and a bottom and on both sides of the connector body 11.

Thus, the grounding unit 100 may be fixedly engaged with one or two of the grounding rods 12 in a selective manner.

The configuration of the grounding unit 100 is described with reference to FIGS. 1, 2, and 3.

The grounding unit 100 for a high-frequency connector may include a grounding unit body 110 which is selectively fixed to the high-frequency connector 10, and a grounding fixation unit 120 with a specific width. The grounding fixation unit 120 is connected to the grounding unit body 110, is in pressing contact with a bottom of the PCB 50 by applying a certain amount of elastic force to the bottom, and electrically connects the high-frequency connector 10 and the grounding regions 51 and 52 of the PCB 50. In this case, the grounding unit 100 may be formed of a conductive material.

The grounding unit body 110 may include an engagement body to be fixedly engaged with a grounding rod 12 which protrudes from the connector body 11, and to be in electrically contact with the grounding rod 12. Thus, an inner wall of the engagement body 111 is in physically close contact with an outer surface of the grounding rod 12 to achieve a conducting state.

Further, the engagement body 111 has exposure holes 112 on both sides to expose outer surfaces of the grounding rod 12. In this case, a plurality of exposure holes 112 may be formed on each side of the engagement body 111. Each exposure hole 112 may function as a path from which a soldering material such as lead to solder the upper grounding region 51 of the PCB 50 and the outer surface of the grounding rod 12, which will be described later. Moreover, the solder (lead) flows into the exposure holes 112, thereby ensuring greater electrical and mechanical stability.

Hence, a contact area between the outer surface of the grounding rod 12 and the solder material may increase with the number of the exposure holes 112, and thus soldering force between the upper grounding region 51 of the PCB 50 and the engagement body 111 may be increased. Further, the solder is inserted into the exposure holes 112, and thus soldering can be more electrically stabilized. Furthermore, the exposure holes 112 may reduce friction between the outer surface of the grounding rod 12 and the inner wall of the engagement body 111 to ease the engagement between the grounding rod 12 and the engagement body 111.

In addition, an upper portion of the engagement body 111 may be divided into two segments in a longitudinal direction detachable from each other. Accordingly, both sides of the engagement body 111 may be allowed to open wide or close tight by the divided upper portions, and thus enable to guide the grounding rod 12 with a different cross-sectional area to be easily inserted into the engagement body 111.

A lower portion of the engagement body 111 may be divided along the length direction.

In addition, the grounding fixation unit 120 may be composed of a first fixation body 121, a second fixation body 122, and a third fixation body 123. The first fixation body 121 extends downward from a lower end of the engagement body 111. The second fixation body 122 is bent from the first fixation body 121 and extends upward at a certain angle along the lower portion of the engagement body 111 while maintaining a predefined distance from the lower surface of the engagement body 111. The third fixation body 123 is curved from an end of the second fixation body 122 toward the lower surface of the engagement body 111, and has an end to be spaced apart from the lower surface of the engagement body 111. The third fixation body 123 applies a predefined amount of elastic force to make the PCB 50 to be in close contact with the lower surface of the engagement body 111. In this case, the grounding fixation unit 120 may be in the form of a plane that has a predefined width and a predefined amount of elastic force.

Referring to FIGS. 5 to 7, the PCB 50 may be inserted into a space between the lower surface of the engagement body 111 and the third fixation body 123 with guidance by an end of the third fixation body 123. In this case, the end of the third fixation body 123 is formed to be wide open from the lower surface of the engagement body 111 while making an arc, and the arc may guide the PCB 50 to be lead into the space. In Embodiment 1, the PCB 50 to be inserted into the space may have a thickness between about 0.3 and 1.8 mm.

Accordingly, the PCB 50 can be easily inserted into the space between a convexly curved portion of the third fixation body 123 and the lower surface of the engagement body 111. In this case, the upper grounding region 51 is formed on an upper surface of the PCB 50, and a lower grounding region 52 is formed on an opposite lower surface of the PCB 50. Further, a plurality of via-holes 51*a* are formed on the upper and lower grounding regions 51 and 52.

Hence, the upper grounding region 51 of the PCB 50 is in contact with the lower surface of the engagement body 111, and the lower grounding region 52 is in contact with a top surface of the convexly curved portion of the third fixation body 123. The grounding fixation unit 120 which includes the third fixation body 123 may provide a predefined amount of elastic force to the PCB 50 in contact with the top surface of the third fixation body 123.

Thus, the PCB 50 is allowed to be interposed between the lower surface of the engagement body 111 and the top surface of the third fixation body 123 and be pressed and fixed by the elastic force.

By flattening the convexly curved portion of the third fixation body 123, the lower grounding region 52 of the PCB 50 increases in the contact area from line contact to surface contact.

Additionally, the outer surface of the grounding rod 12 which is inserted into the engagement body 111 is exposed to the outside via the exposure holes 112 formed on both sides of the engagement body 111.

In this state, the upper grounding region 51 of the PCB 50, the lower surface of the engagement body 111, and the outer surface of the grounding rod 12 to be exposed via both sides and the exposure holes 112 of the engagement body 111 may be soldered by a solder material.

That is, the solder material directly solders the upper grounding region 51, the engagement body 111, and the outer surface of the grounding rod 12 which is exposed via the exposure holes 12, so that the upper grounding region 51 and the grounding rod 12 can directly conduct each other, and thus the ground stability can be achieved. Further, the solder material does not have to be inserted into the exposure holes 112, and even when a lower portion of the exposure holes 112 is soldered, the electrical connectivity can be drastically increased.

Thus, the upper grounding region 51, the engagement body 111, and the outer surface of the grounding rod 12 which is exposed via the exposure holes 112 are directly soldered by the soldering material, so that the electrical/mechanical stability between the PCB 50 and the grounding rod 12 can be improved.

In addition, although the lower grounding region 52 is formed on a lower surface of the PCB 50 in the above example, the grounding unit 100 in accordance with Embodiment 1 may be employed by a PCB having only the upper grounding region 51. In this case, the upper grounding region 51 may be soldered as described above, and the lower surface of the PCB 50 may be fixed by an elastic force from the third fixation body 123.

Meanwhile, the first fixation body 121 may extend to form an obtuse angle with the lower cross section of the engagement body 111, and in this case, the connector body 11 of the high-frequency connector 10 on which one or more grounding rods 12 are provided may further include a space portion 11*a* in which the first fixation body 121 can move within a certain range.

In a case where the PCB 50 is interposed between a space between the lower surface of engagement body 111 and the third fixation body 123, the space portion 11*a* provides a space to allow the first fixation body 121 to move backward such that the third fixation body 123 can move downward, that is, the third fixation body 123 can be further separated from the lower surface of the engagement body 111, for example, by a thickness of the PCB 50. Moreover, when the first fixation body 121 moves backward, the first fixation body 121 may be stopped by an inner wall of the space portion 11*a*, and thus the space portion 11*a* may function as a stopper for the first fixation body 121.

Although the space portion 11*a* is provided on each side of the connector body 11 to receive the first fixation body 121 in Embodiment 1, the space portion 11*a* may be provided outside of each side of the connector body 11.

Embodiment 2

Figure 8:
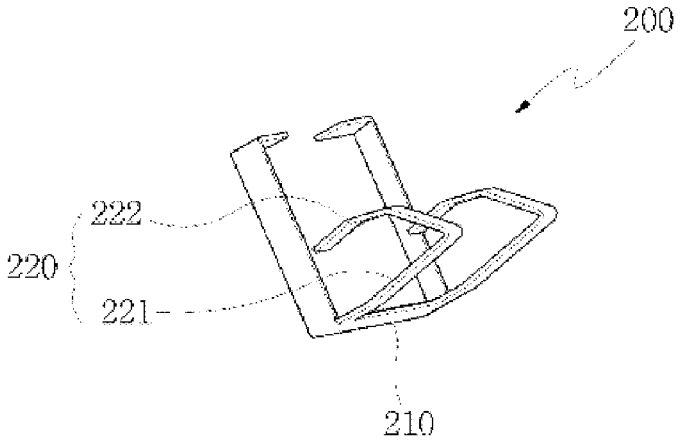
FIG. 8 is a perspective view of a grounding unit for a high-frequency connector according to Embodiment 2.
Figure 9:
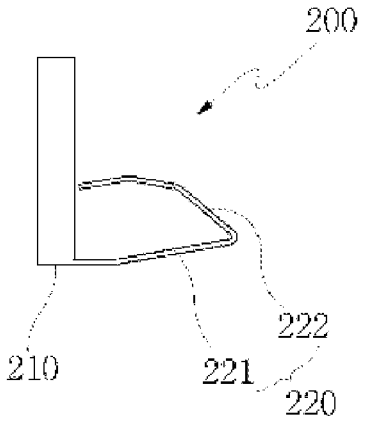
FIG. 9 is a side view of the grounding unit shown in FIG. 9.
Figure 10:
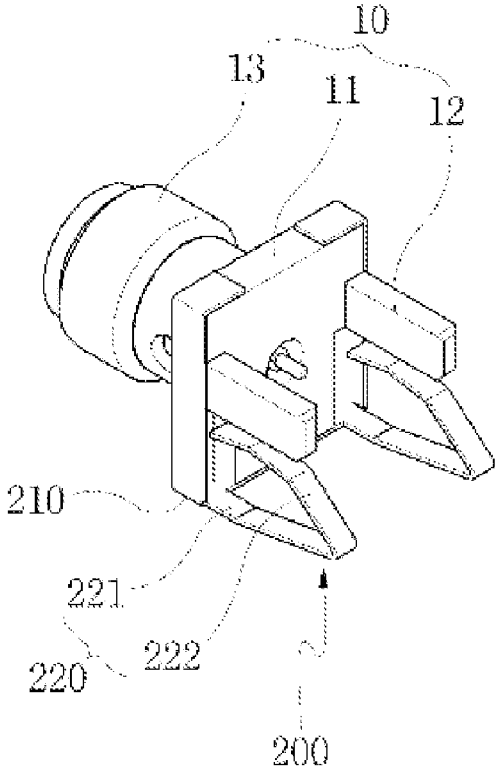
FIG. 10 is a perspective view of a high-frequency connector module employing the grounding unit shown in FIG. 8.
Figure 11:
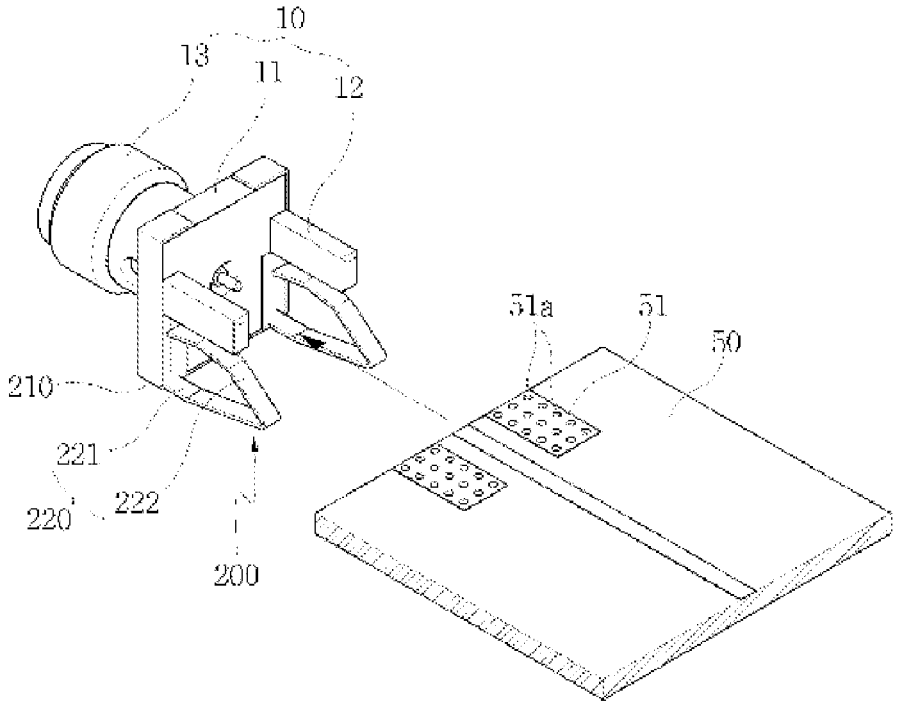
FIG. 11 is another perspective view of a high-frequency connector module employing the grounding unit shown in FIG. 8.
Figure 12:
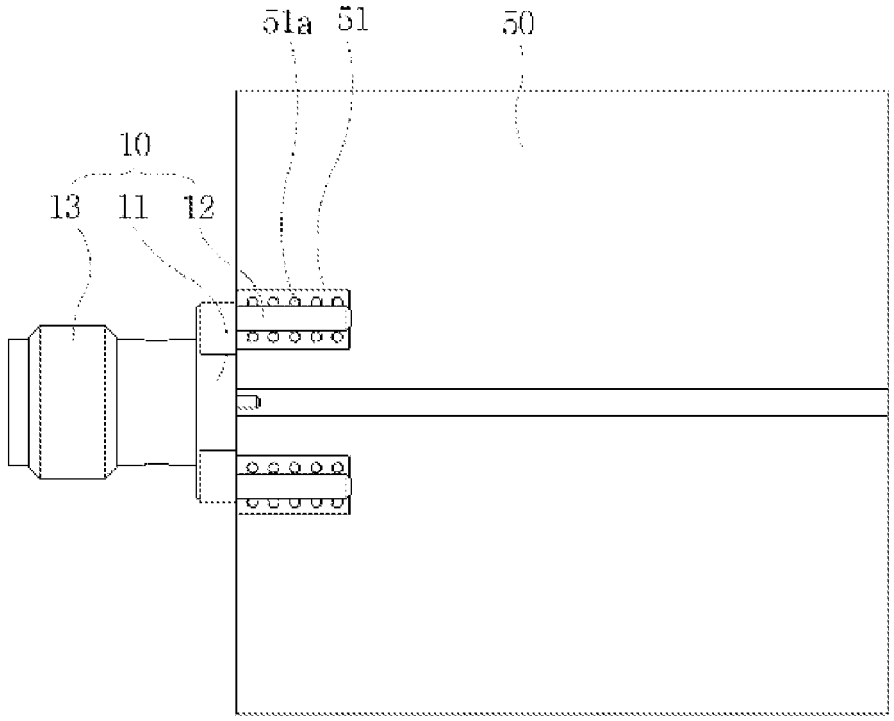
FIG. 12 is a plan view of the high-frequency connector module shown in FIG. 10.
Figure 13:
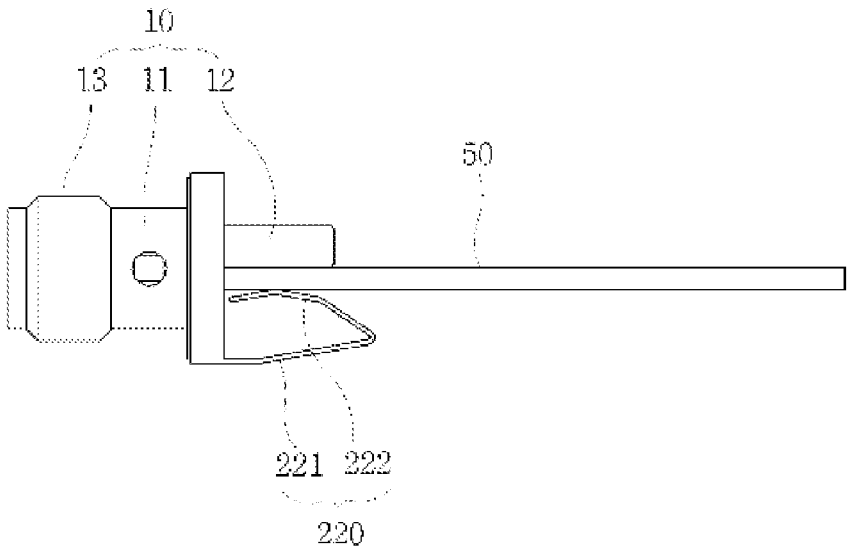
FIG. 13 is a side view of the high-frequency connector module shown in FIG. 10.
Figure 14:
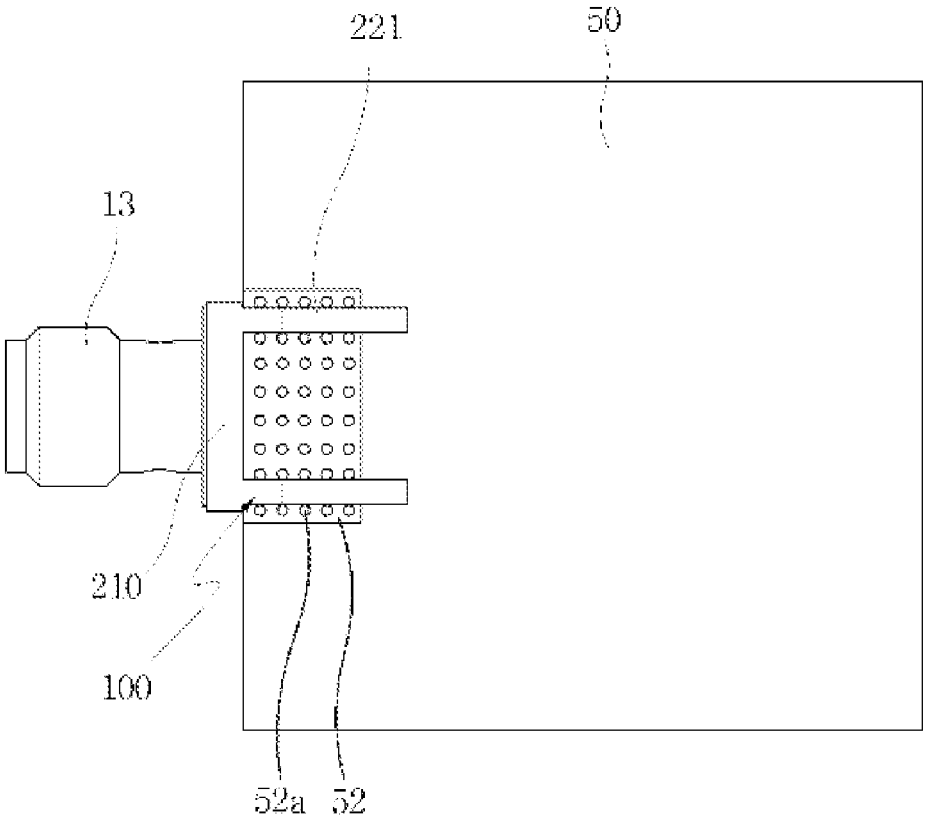
FIG. 14 is a bottom view of the high-frequency connector module shown in FIG. 10.

FIG. 8 illustrates a perspective view of a grounding unit for a high-frequency connector according to Embodiment 2. FIG. 9 illustrates a side view of the grounding unit shown in FIG. 9. FIG. 10 illustrates a perspective view of a high-frequency connector module employing the grounding unit shown in FIG. 8. FIG. 11 illustrates another perspective view of a high-frequency connector module employing the grounding unit shown in FIG. 8. FIG. 12 illustrates a plan view of the high-frequency connector module shown in FIG. 10. FIG. 13 illustrates a side view of the high-frequency connector module shown in FIG. 10. FIG. 14 illustrates a bottom view of the high-frequency connector module shown in FIG. 10.

The high-frequency connector 10 that employs the grounding unit 200 according to Embodiment 2 may include a pair of grounding rods 12. The high-frequency connector 10 of Embodiment 2 may be substantially the same as the high-frequency connector 10 of Embodiment 1.

Referring to FIGS. 8 to 10, the grounding unit 200 according to Embodiment 2 may include a grounding unit body 210 and a grounding fixation unit 220 which is provided to the grounding unit body 210.

The grounding unit body 210 may enclose outer edges of the connector body 11 of the high-frequency connector 10 which include a pair of the grounding rods 12 extending for a predefined length. In this case, the connector body 11 may be formed in a rectangular shape having four outer edges with a predefined thickness. Hence, inner surfaces of the grounding unit body 210 are in close contact with the four outer edges of the connector body 11.

An upper portion of the grounding unit body 210 may be separated. Accordingly, the grounding unit body 210 formed as a thin film is open to easily enclose the outer edges of the connector body 11. That is, since the grounding unit body 210 can be open wide, it can be fixed in contact with the outer edges of the connector body 11 of various sizes.

A pair of grounding fixation units 220 each of which protrudes from each lower side of the grounding unit body 210 may be provided. Substantially, the grounding fixation units 220 extending from the lower side of the grounding unit body 210 may be provided as many as the number of the grounding rods 12.

The grounding fixation units 220 may be composed of a first fixation body 221 and a second fixation body 222. The first fixation body 221 may protrude stepwise from each lower side of the grounding unit body 210 for a predefined length, and the second fixation body 222 may extend stepwise from an end of the first fixation body 221, be curved toward a lower portion of the grounding rod 12, and apply a predefined amount of elastic force to the PCB 50 such that the PCB 50 which is inserted into the lower portion of a pair of the grounding rods 12 can be in contact with lower surfaces of a pair of the grounding rod 12.

In this case, a space in which the PCB 50 is inserted is a space between the lower surfaces of a pair of the grounding rods 12 and top surfaces of the second fixation bodies 222.

Therefore, when the PCB 50 is inserted into the space, the PCB 50 is guided for insertion into the space while being in contact with an outer surface of the second fixation body 222 extending from the end of the first fixation body 221. In addition, according to the thickness of the PCB 50, the second fixation body 222 is open downwards, and at this time, the first fixation body 221 is also bent downward.

The first and second fixation bodies 221 and 222 provide a resilient elastic force in respect of the PCB 50. Accordingly, the PCB 50 is fixedly engaged between the grounding rods 12 and the second fixation bodies 222 while an upper surface of the PCB 50 is in close contact with the lower surfaces of the grounding rods 12 and a lower surface of the PCB 50 is in contact with the top surfaces of the second fixation bodies 222.

In addition, there is no means to function as a stopper to stop the first fixation body 221 from being bent downward, and hence a PCB thicker than the PCB 50 described in Embodiment 1 can be applied.

Additionally, the upper grounding region 51 formed on the upper surface of the PCB 50 may be in contact with lower surfaces of a pair of the grounding rods 12 and the lower grounding region 52 formed on a lower surface of the PCB 50 may be in contact with the top surface of the second fixation body 222.

Moreover, an end of the second fixation body 222 may protrude for a certain length to be longer than the grounding rod 12.

Accordingly, the second fixation body 222 may enable to provide a sufficient elastic force to the PCB 50 to be inserted into the space and the first fixation body 221 and the second fixation body 222 can maintain a constant distance, so that manufacturing for connecting the PCB 50 to the grounding fixation unit 220 and the grounding rod 12 can be easily achieved.

Then, the lower surfaces of a pair of the grounding rods 12 and the upper grounding portion 51 may be soldered by a solder material, and the second fixation body 222 may also be soldered to the lower grounding region 52 of the PCB 50.

Consequently, the PCB 50 is tightly engaged between the grounding rods 12 and the second fixation body 222 by elastic power from the grounding fixation unit 220, and then undergoes soldering process, so that the mechanical stability by the soldering can be maintained.

Moreover, since the grounding rods 12 are directly soldered to the upper grounding region 51, soldering efficiency may be increased.

Embodiment 3

Figure 15:
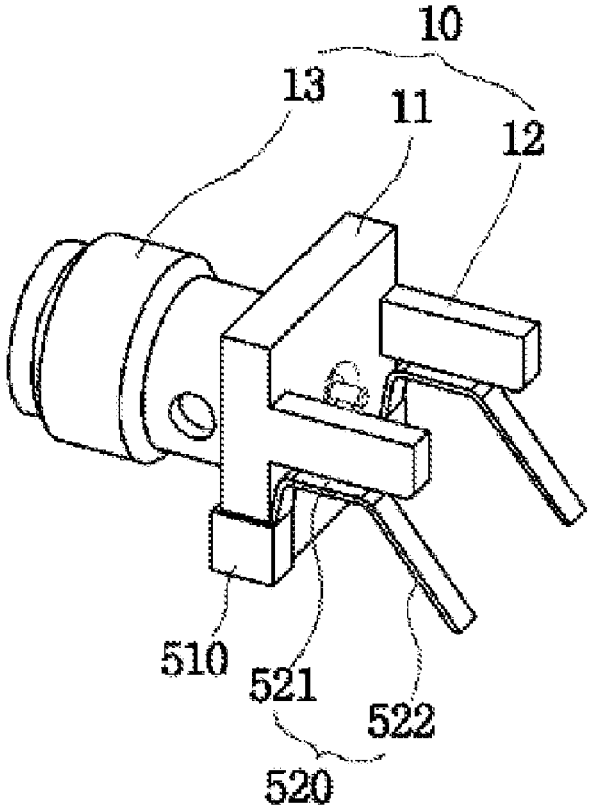
FIG. 15 is a perspective view of a high-frequency connector module employing a grounding unit for a high-frequency connector according to Embodiment 3.
Figure 16:
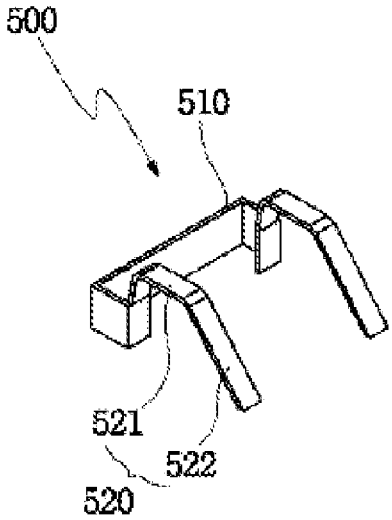
FIG. 16 is a perspective view of the grounding unit shown in FIG. 15.
Figure 17:
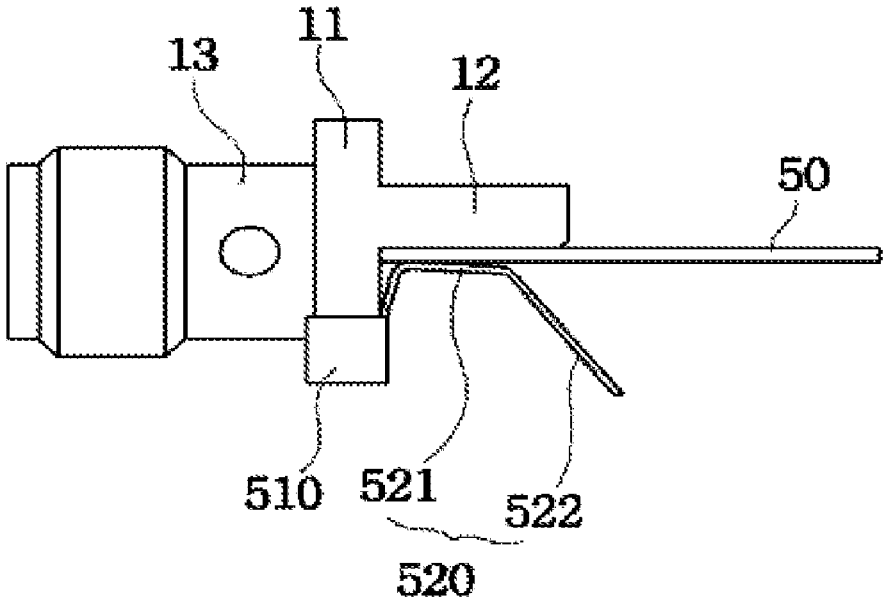
FIG. 17 illustrates a side view showing connection between the high-frequency connector module shown in FIG. 15 and a printed circuit board (PCB).

FIG. 15 illustrates a perspective view of a high-frequency connector module employing a grounding unit for a high-frequency connector according to Embodiment 3. FIG. 16 illustrates a perspective view of the grounding unit shown in FIG. 15. FIG. 17 illustrates a side view showing connection between the high-frequency connector module shown in FIG. 15 and a printed circuit board (PCB).

Referring to FIG. 15, the high-frequency connector 10 employing the grounding unit 500 according to Embodiment 3 may include a pair of grounding rods 12. The high-frequency connector 10 shown in FIG. 15 may be substantially the same as the high-frequency connector 10 of Embodiment 2.

Referring to FIGS. 15 to 17, the grounding unit 500 according to Embodiment 3 may include a grounding unit body 510 and a grounding fixation unit 520 which is provided on the grounding unit body 510.

The grounding unit body 510 with a given length may be installed to have both ends facing each other on a lower portion of a pair of the grounding rods 12 and enclosing a connector body 11.

The grounding fixation unit 520 may be composed of a first fixation body 521 and a second fixation body 520. The first fixation body 521 may be bent in a shape of ⌐ from each upper side of the grounding unit body 510 located at a lower portion of a pair of the grounding rods 12, such that the PCB 50 inserted into the lower portion of the grounding rods 12 can be in contact with lower surfaces of the grounding rods 12. The second fixation body 522 may be tilted downward from an end of the first fixation body 521.

Thus, when the PCB 50 is inserted into a space between a pair of the grounding rods 12 and the first fixation body 521, the PCB 50 comes in close contact with a top surface of the first fixation body 521. In addition, according to the thickness of the PCB 50, the first fixation body 521 moves downward to be further away from the lower portion of the grounding rod 12, and at the same time, the second fixation body 522 is also bent downward. In this case, the second fixation body 522 may be applied external force downwards to widen a space between the grounding rod 12 and the first fixation body 501 for withdrawing the PCB 50.

The first and second fixation bodies 521 and 522 provide a resilient elastic force in respect of the PCB 50. Accordingly, the PCB 50 can be fixedly engaged between the grounding rod 12 and the grounding fixation unit 520 while an upper surface of the PCB 50 is in close contact with a lower surface of the grounding rod 12 and a lower surface is in close contact with the top surface of the first fixation body 521.

Embodiment 4

Figure 18:
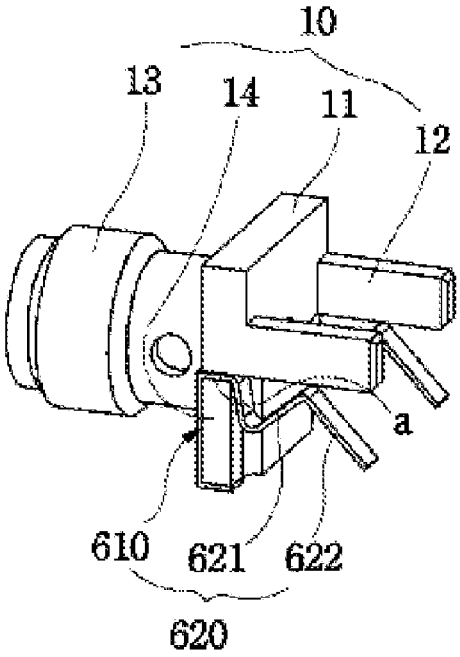
FIG. 18 is a perspective view of a high-frequency connector module employing a grounding unit for a high-frequency connector according to Embodiment 4.
Figure 19:
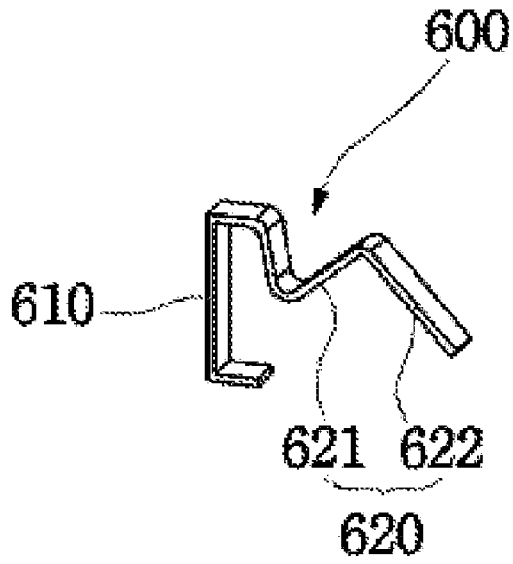
FIG. 19 is a perspective view of the grounding unit shown in FIG. 18.
Figure 20:
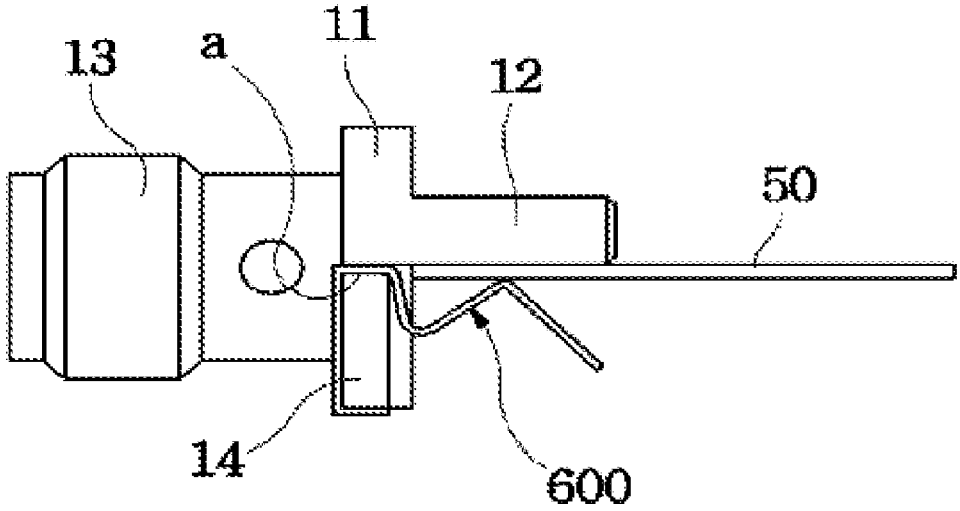
FIG. 20 is a side view showing connection between the high-frequency connector module shown in FIG. 18 and a PCB.

FIG. 18 illustrates a perspective view of a high-frequency connector module employing a grounding unit for a high-frequency connector according to Embodiment 4. FIG. 19 illustrates a perspective view of the grounding unit shown in FIG. 18. FIG. 20 illustrates a side view showing connection between the high-frequency connector module shown in FIG. 18 and a printed circuit board (PCB).

Referring to FIGS. 18 to 20, the grounding unit 600 according to Embodiment 4 may include a grounding unit body 610 and a grounding fixation unit 620 which is provided to the grounding unit body 610.

The high-frequency connector 10 according to Embodiment 4 may include a connector body 11 which includes a pair of first grounding rods 12 and a pair of second grounding rods 14. The first grounding rods 12 extend for a given length, and the second grounding rods 14 are disposed to maintain a constant gap (a) from lower ends of the first grounding rods 12. Here, the high-frequency connector 10 of Embodiment 4 is characterized in further including the second grounding rods 14, compared to the high-frequency connector 10 of Embodiment 3. In addition, a pair of the first grounding rods 12 and a pair of the second grounding rods 14 may be disposed to be perpendicular to one another.

In this case, the grounding unit body 610 with a predefined length may be installed on each second grounding rod 14 to be in close contact with a top surface and a lower surface of the second grounding rod 14.

The grounding fixation unit 620 may include a first fixation body 621 and a second fixation body 622. The first fixation body 621 extends from an end of the grounding unit body 610 placed on an upper portion of each second grounding rod and is bent in a V shape. The second fixation body 622 extends at a downward angle from an end of the first fixation body 621.

The PCB 50 to be inserted into a lower portion of a pair of the first grounding rods 12 may be elastically supported by a connect portion connecting the first fixation body 621 and the second fixation body 622.

Hence, the PCB 50 which is inserted into a space between a pair of the first grounding rods 12 and the first fixation body 521 comes in close contact with the connect portion connecting the first fixation body 621 and the second fixation body 622. In addition, according to the thickness of the PCB 50, the first fixation body 621 moves downward further away from the lower portion of the first grounding rod 12, and the second fixation body 622 is also curved downward. In this case, the second fixation body 621 applies external force downward to widen the space between the first grounding rod 12 and the first fixation body 621 for withdrawing the PCB 50.

The first and second fixation bodies 621 and 622 provide a resilient elastic force in respect of the PCB 50. Accordingly, the PCB 50 is enabled to be fixedly engaged between the first grounding rod 12 and the grounding fixation body 620 while an upper surface of the PCB 50 is in contact with a lower surface of the first grounding rod 12 and a lower surface is in contact with the connect portion between the first and second fixation bodies 621 and 622.

Embodiment 5

Figure 21:
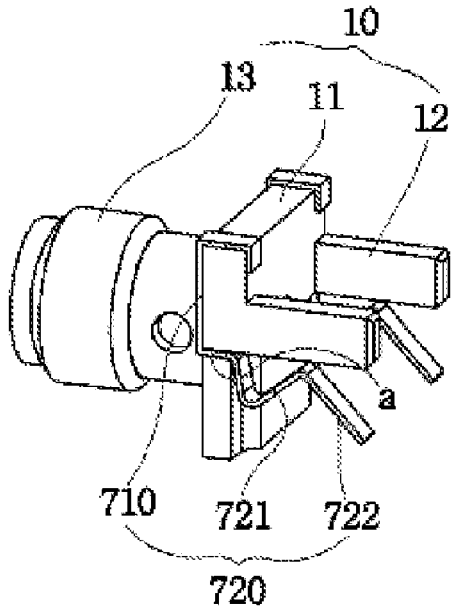
FIG. 21 is a perspective view of a high-connector module employing a grounding unit for a high-frequency connector according to Embodiment 5.
Figure 22:
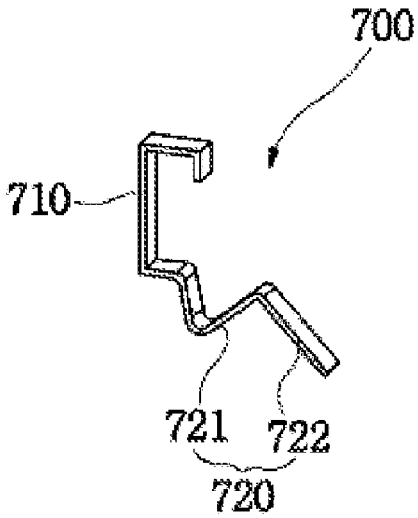
FIG. 22 is a perspective view of the grounding unit shown in FIG. 21.
Figure 23:
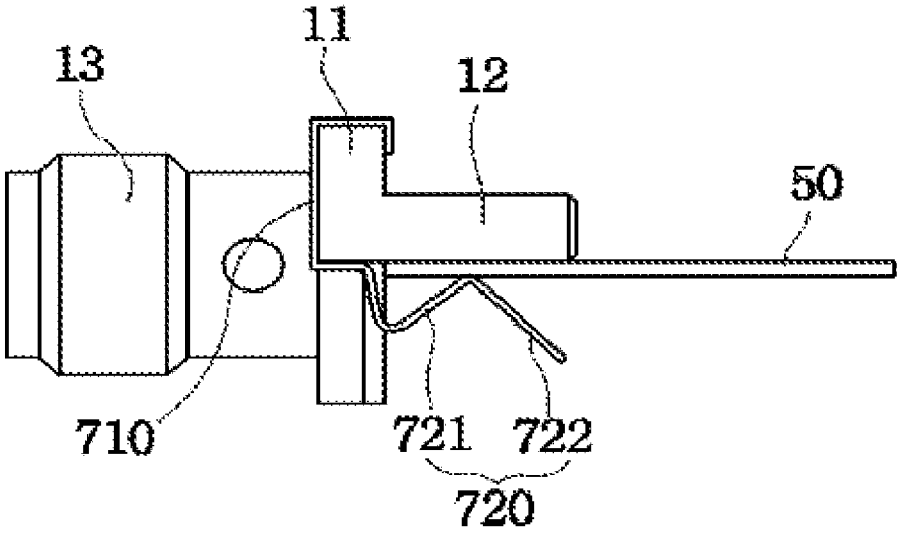
FIG. 23 is a side view of connection between the high-frequency connector module shown in FIG. 21 and a PCB.

FIG. 21 illustrates a perspective view of a high-connector module employing a grounding unit for a high-frequency connector according to Embodiment 5. FIG. 22 illustrates a perspective view of the grounding unit shown in FIG. 21. FIG. 23 illustrates a side view of connection between the high-frequency connector module shown in FIG. 21 and a printed circuit board (PCB).

Referring to FIGS. 21 to 23, the grounding unit 700 according to Embodiment 5 may include a grounding unit body 710 and a grounding fixation unit 720 which is provided on the grounding unit body 710.

The high-frequency connector 10 in accordance with Embodiment 5 may include a connector body 11 which includes a pair of first grounding rods 12, each extending for a given length, and a pair of second grounding rods 14 disposed to maintain a predefined gap (a) with a lower portion of a pair of the first grounding rods 12.

The grounding unit body 710 having a predefined length may be installed in contact with a side of the connector body 11 and may have two ends, one being in contact with an upper portion of the connector body 11 and the other being in contact with an inner wall of the gap (a).

The grounding fixation unit 720 includes a first fixation body 721 and a second fixation body 722. The first fixation body 721 extends from an end of the grounding unit body 710 located at a lower portion of each first grounding rod 12 and is bent in a V shape, and the second fixation body 722 extends at a downward angle from an end of the first fixation unit 721.

The PCB 50 which is inserted into a lower portion of a pair of the first grounding rods 12 may be elastically supported by a connect portion connecting the first fixation body 721 and the second fixation body 722.

Therefore, if the PCB 50 is inserted into a space between a pair of the first grounding rods 12 and the first fixation body 721, the PCB 50 comes in close contact with the connect portion between the first fixation body 721 and the second fixation body 722. In addition, according to the thickness of the PCB 50, the first fixation body 721 moves downward further away from the first grounding rod 12, and at the same time, the second fixation body 722 is also bent downward. In this case, the second fixation body 721 may apply external force downward to widen the space between the first grounding rod 12 and the first fixation body 721 for withdrawing the PCB 50.

Then, the first and second fixation bodies 721 and 722 provide a resilient elastic force in respect of the PCB 50. Accordingly, the PCB 50 can be fixedly engaged between the grounding rod 12 and the grounding fixation unit 720 while an upper surface of the PCB 50 is in close contact with a lower surface of the grounding rod 12 and a lower surface is in close contact with the connect portion between the first and the second fixation bodies 721 and 722.

Embodiment 6

Figure 24:
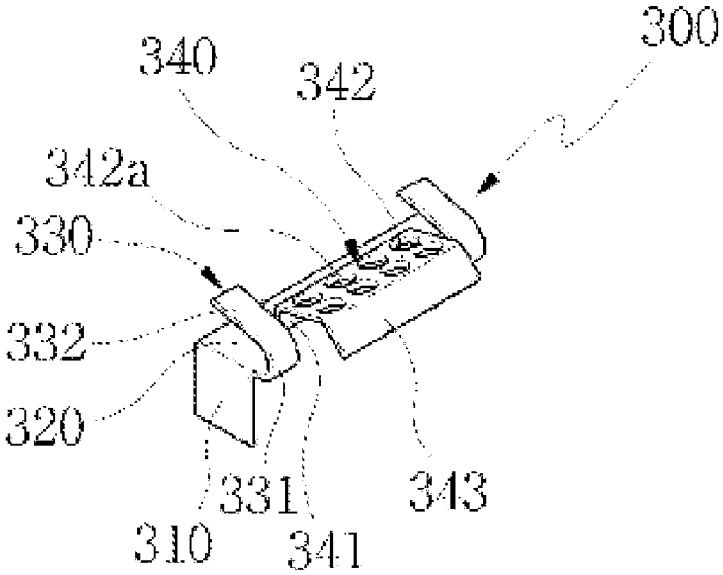
FIG. 24 is a perspective view of a grounding unit for a high-frequency connector according to Embodiment 6.
Figure 25:
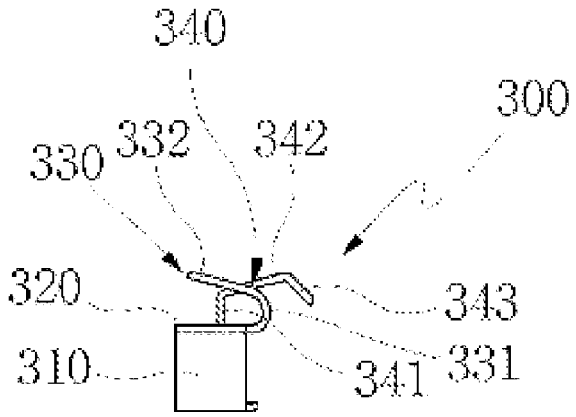
FIG. 25 is a side view of the grounding unit shown in FIG. 24.
Figure 26:
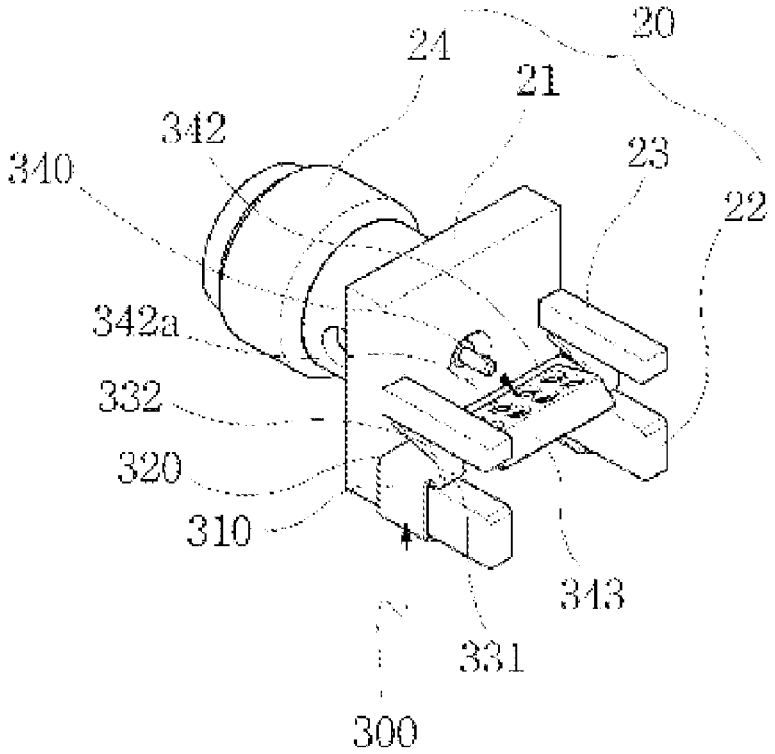
FIG. 26 is a perspective view of a high-frequency connector module employing the grounding unit shown in FIG. 24.
Figure 27:
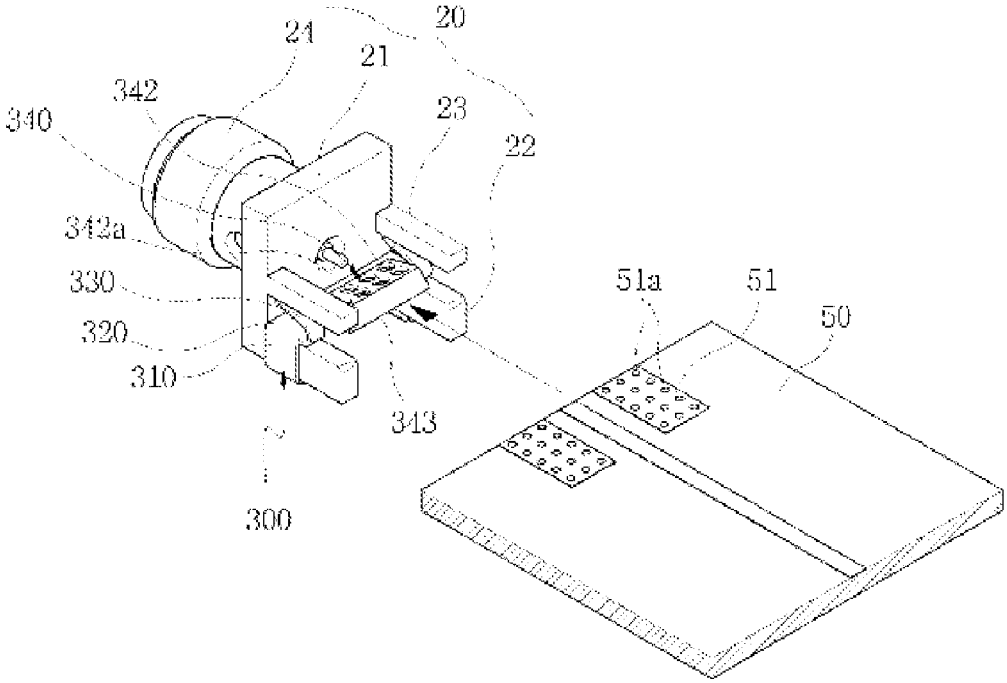
FIG. 27 is another perspective view of the high-frequency connector module employing the grounding unit shown in FIG. 24.
Figure 28:
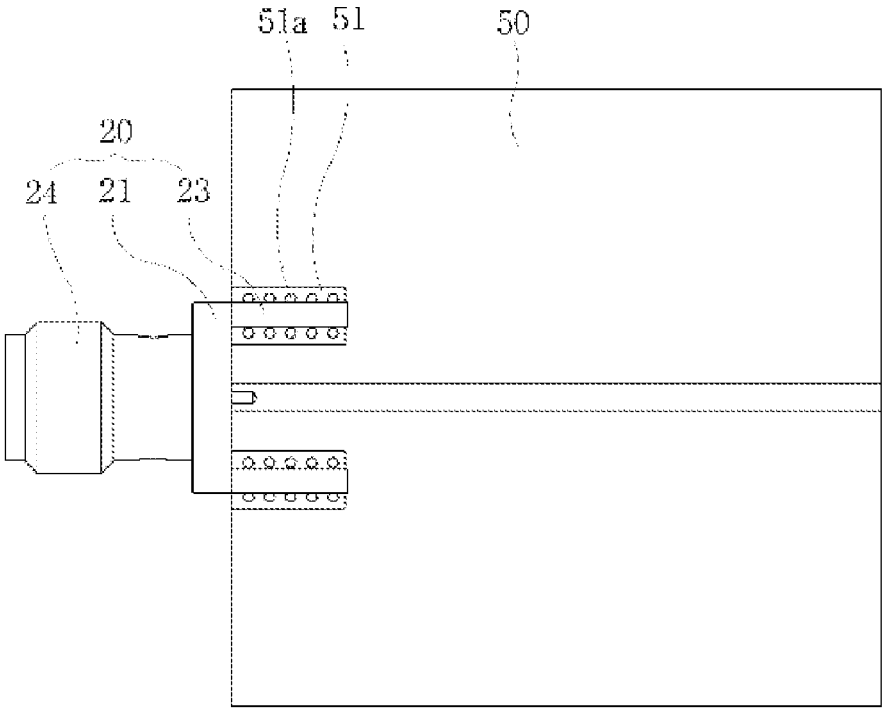
FIG. 28 is a plan view of the high-frequency connector module shown in FIG. 24.
Figure 29:
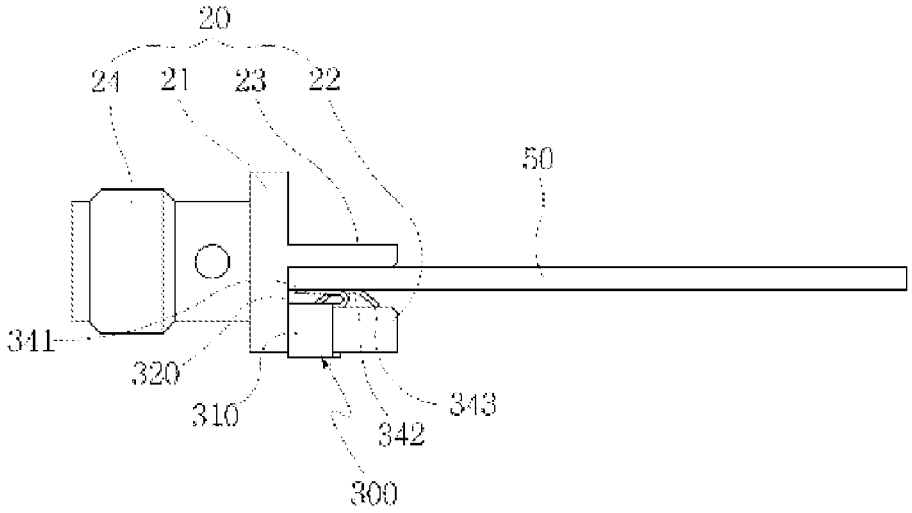
FIG. 29 is a side view of the high-frequency connector module shown in FIG. 24.
Figure 30:
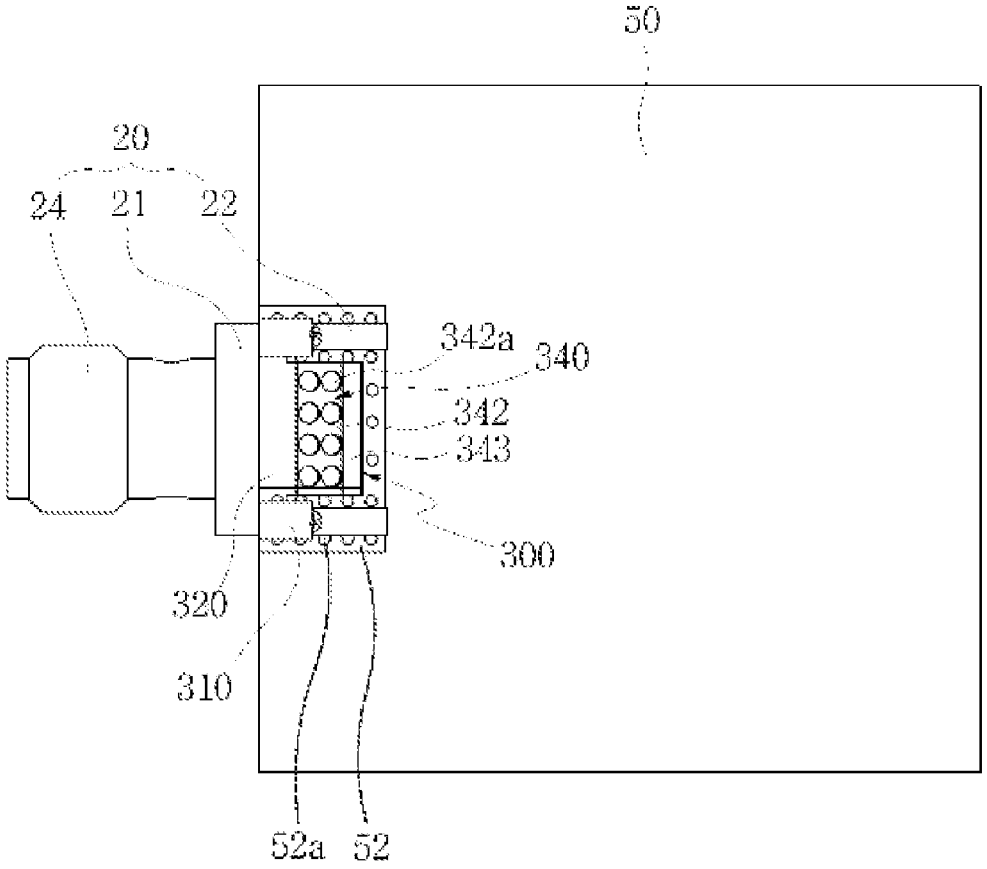
FIG. 30 is a bottom view of the high-frequency connector module shown in FIG. 24.

FIG. 24 illustrates a perspective view of a grounding unit for a high-frequency connector according to Embodiment 6. FIG. 25 illustrates a side view of the grounding unit shown in FIG. 24. FIG. 26 illustrates a perspective view of a high-frequency connector module employing the grounding unit shown in FIG. 24. FIG. 27 illustrates another perspective view of the high-frequency connector module employing the grounding unit shown in FIG. 24. FIG. 28 illustrates a plan view of the high-frequency connector module shown in FIG. 24. FIG. 29 illustrates a side view of the high-frequency connector module shown in FIG. 24. FIG. 30 illustrates a bottom view of the high-frequency connector module shown in FIG. 24.

Referring to FIGS. 24 to 28, the high-frequency connector 20 employing the grounding unit 300 according to Embodiment 6 may include a connector body 21, a pair of first grounding rods 22, and a pair of second grounding rods 23. The connector body 21 includes a connection unit 24 which is substantially the same as the connection unit 13 of Embodiment 1, a pair of the first grounding rods 22 protrude from both lower sides of the connector body 21, and a pair of the second grounding rods 23, which are disposed above a pair of the first grounding rods 22 at a determined distance, protrude from both sides of the connector body 21. Hence the first grounding rod 22 and the second grounding rod 23 are spaced apart at a predefined distance from each other.

Referring to FIGS. 24 to 29, the grounding unit 300 according to Embodiment 6 may include a grounding unit body which is engaged with a pair of the first grounding rods 22 and a grounding fixation unit 330 which is provided on the grounding unit body to elastically support a lower surface of the PCB 50 at a plurality of positions.

Referring to FIGS. 24 and 25, the grounding unit body may include a pair of engagement bodies 310 to be fixedly engaged with a pair of the first grounding rods 22 and a connection body 320 to connect an upper portion of the engagement bodies 310. The grounding unit body is formed as a thin film.

In this case, the engagement bodies 310 may have inner side walls facing and open to each other.

Hence, the inner surface of the engagement body 310 is bent in a manner that encloses the first grounding rod 22 and is in close contact with a lower surface and an outer side surface of the first grounding rod 22.

In addition, a lower surface of the connection body 320 is in close contact with a top surface of the first ground rod 22. The engagement body 310 is formed of a metal plate with a given elasticity, and has a side wall and a lower wall bent from an end of the side wall, which are in close contact with the respective side surface and lower surface of the first grounding rod 22. Accordingly, the engagement body 310 and the connection body 320 are fixed to the first grounding rods 22.

Further, the grounding fixation unit 330 includes a first fixation body 331, a second fixation body 332, and a soldering body 340. The first fixation body is bent upward from each front end of the connection body 320. The second fixation body 332 extends for a given length at an upward angle from an end of the first fixation body 331 and is placed on an upper portion of the first grounding rod 22 while being spaced apart at a predefined distance from a lower surface of the second grounding rod 23. The soldering body 340 extends at an upward angle from a rear end of the connection body 320 while the inclination direction of the soldering body 340 crosses the inclination direction of the second fixation body 332, and additionally the soldering body 340 has a plurality of through-holes 342*a*.

An upper grounding region 51 which is formed on an upper surface of the PCB 50 may be in contact with lower surfaces of a pair of the second grounding rods 23 and a lower grounding region 52 which is formed on a lower surface of the PCB 50 may be in contact with a top surface of the second fixation body 332 and a top surface of the soldering body 340. The through-holes 342*a* of the soldering body 340 may expose the lower grounding region 52 to the outside.

The through-holes 342*a* may increase a contact area between the lower grounding region 52 and the solder material (lead) which disperses in the through-holes 342*a*.

In addition, since the inclination directions of the second fixation body 332 and the soldering body 340 cross each other, two contact positions are caused on the lower surface of the PCB 50, one where the top surface of the second fixation body 332 is in contact and the other where the top surface of the soldering body 340 is in contact. The two contact positions may substantially lead to surface contact with the lower surface of the PCB 50, thereby supporting the PCB 50.

Moreover, when the PCB 50 is inserted into a space between the second fixation body 332 and the first grounding rod 22, the PCB 50 may be applied an elastic force from the second fixation body 332 and the soldering body 340.

Therefore, the PCB 50 is enabled to be tightly supported at a plurality of positions by the second fixation body 332 and the soldering body 340, so that mechanically stable fixation can be maintained.

More specifically, the soldering body 340 may be composed of a first soldering body 341, a second soldering body 342, and a third soldering body 343. The first soldering body 341 extends vertically from a top end of the connection body 320. The second soldering body 342 extends at an upward angle from an end of the first soldering body 341, while the inclination direction crosses the inclination direction of the second fixation body 332, and includes the through-holes 342*a* formed thereon. The third soldering body 343 extends at a downward angle from an end of the second soldering body 342. Further, the lower grounding region 52 may be in contact with the top surface of the second soldering body 342.

Accordingly, when the second soldering body 342 is bent downward due to the PCB 50 inserted into the space between the second soldering body 342 and the second grounding rod 23, the degree of downward bending may be determined according to the bending of the first soldering body 341. Thus, since the first soldering body 341 is vertically formed from the connection body 320, an elastic force to be applied to the PCB 50 is enabled to be increased beyond a certain level.

The upper grounding region 51 of the PCB 50 in the state as described above may be soldered to the first grounding rod 22 with a solder material. Then, the solder material flows into the lower grounding region 52 through via-holes 51*a* which are formed on the upper grounding region 51, disperses into the through-holes 342*a* on the second soldering body 342, and thereafter solders the second soldering body 342 to the PCB 50. Accordingly, the ground stability can be achieved.

Embodiment 7

Figure 31:
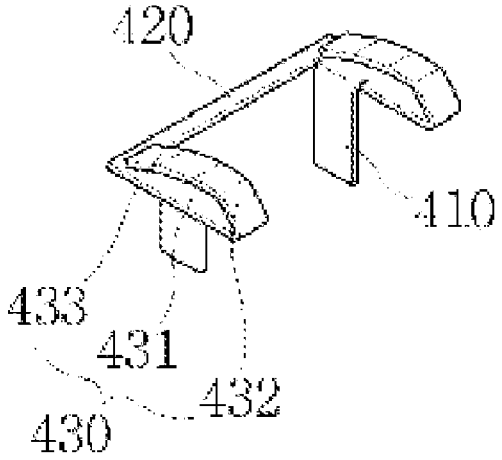
FIG. 31 is a perspective view of a grounding unit for a high-frequency connector according to Embodiment 7.
Figure 32:
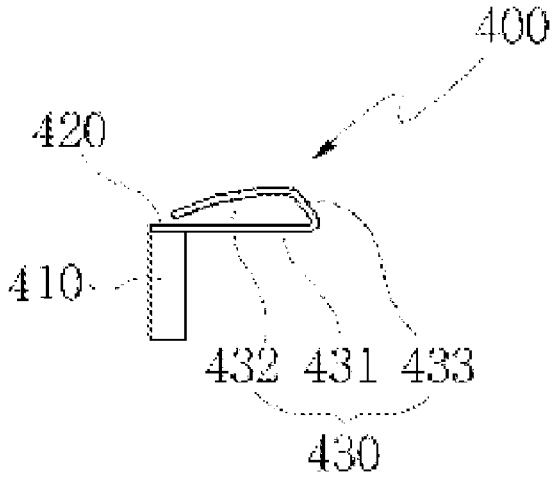
FIG. 32 is a side view of the grounding unit shown in FIG. 31.
Figure 33:
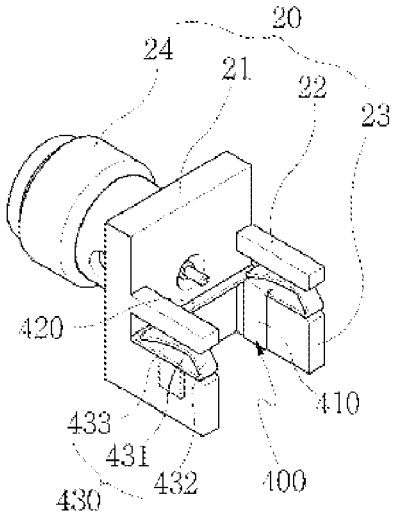
FIG. 33 is a perspective view of a high-frequency connector module employing the grounding unit shown in FIG. 31.
Figure 34:
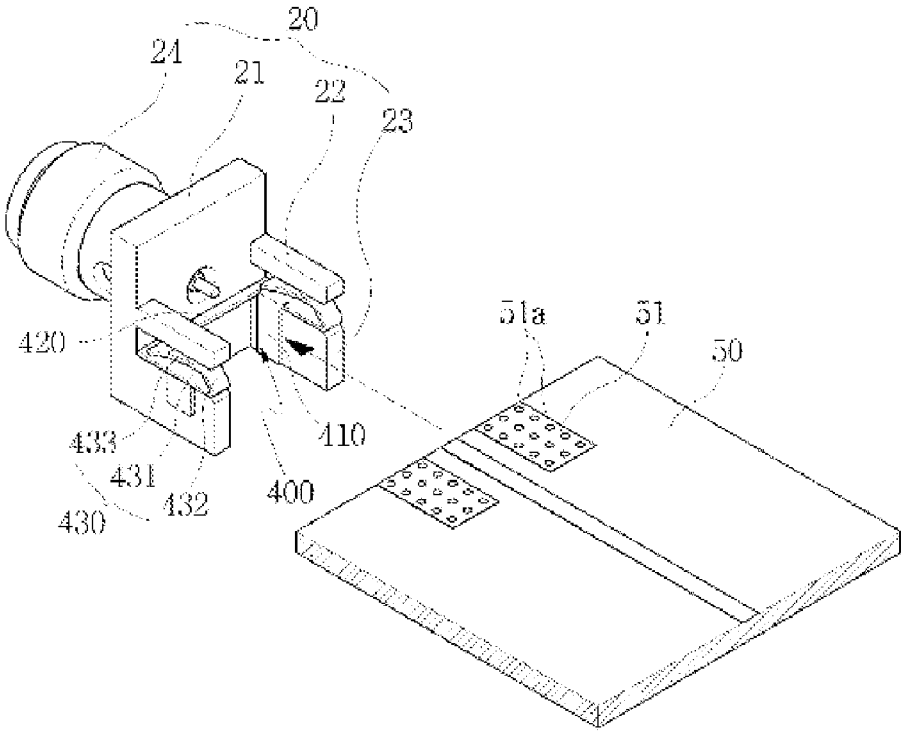
FIG. 34 is another perspective view of the high-frequency connector module employing the grounding unit shown in FIG. 31.
Figure 35:
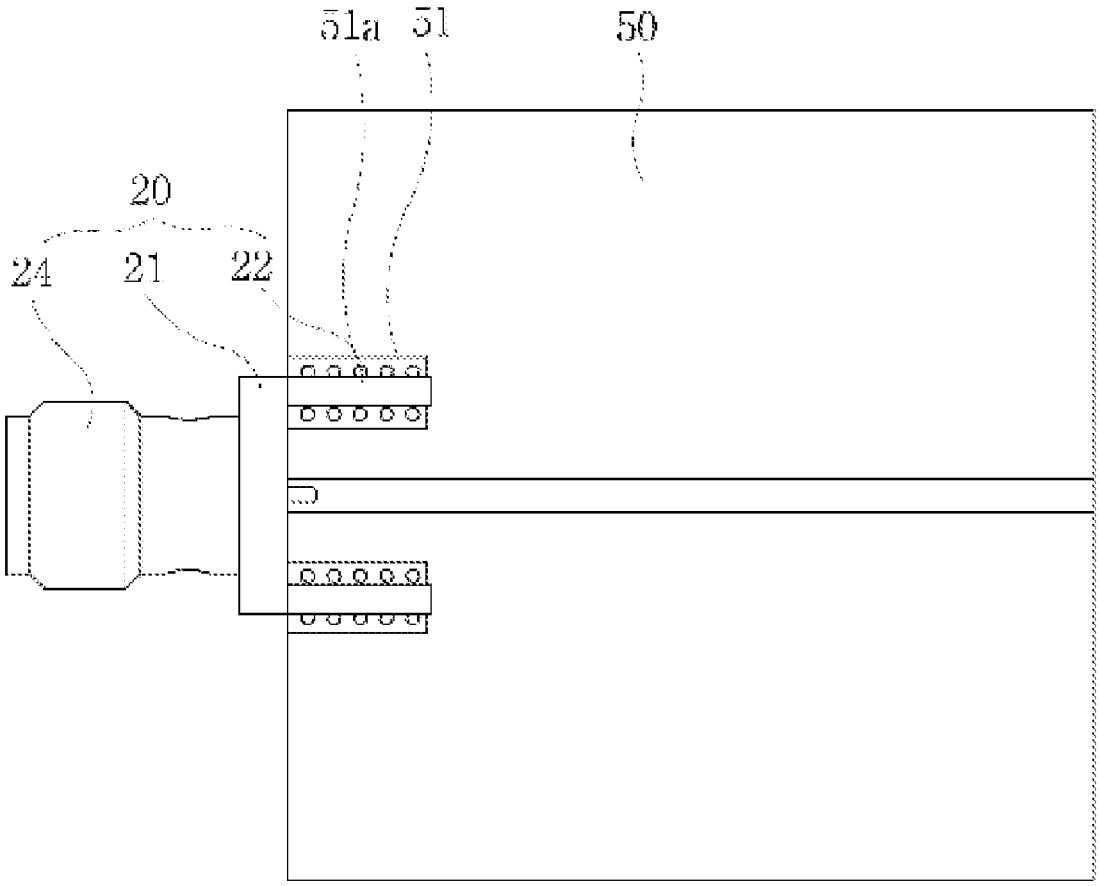
FIG. 35 is a plan view of the high-frequency connector module shown in FIG. 33.
Figure 36:
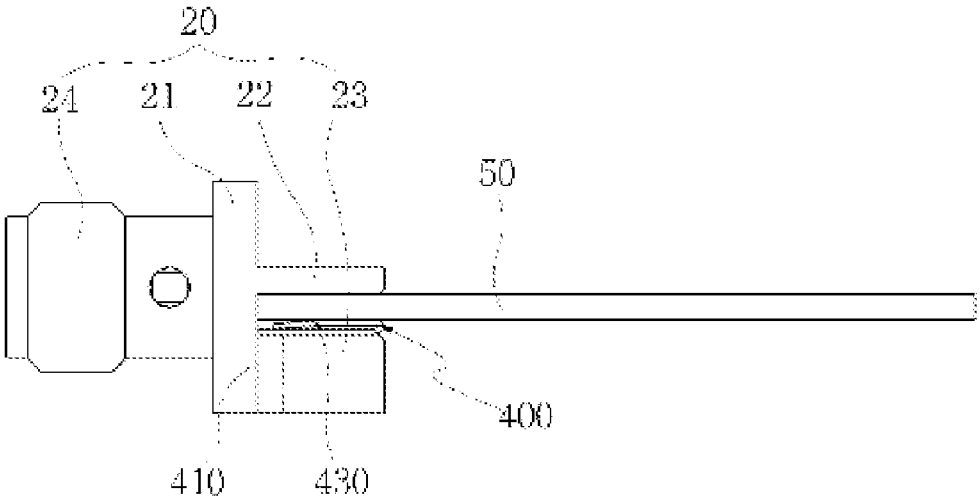
FIG. 36 is a side view of the high-frequency connector module shown in FIG. 33.
Figure 37:
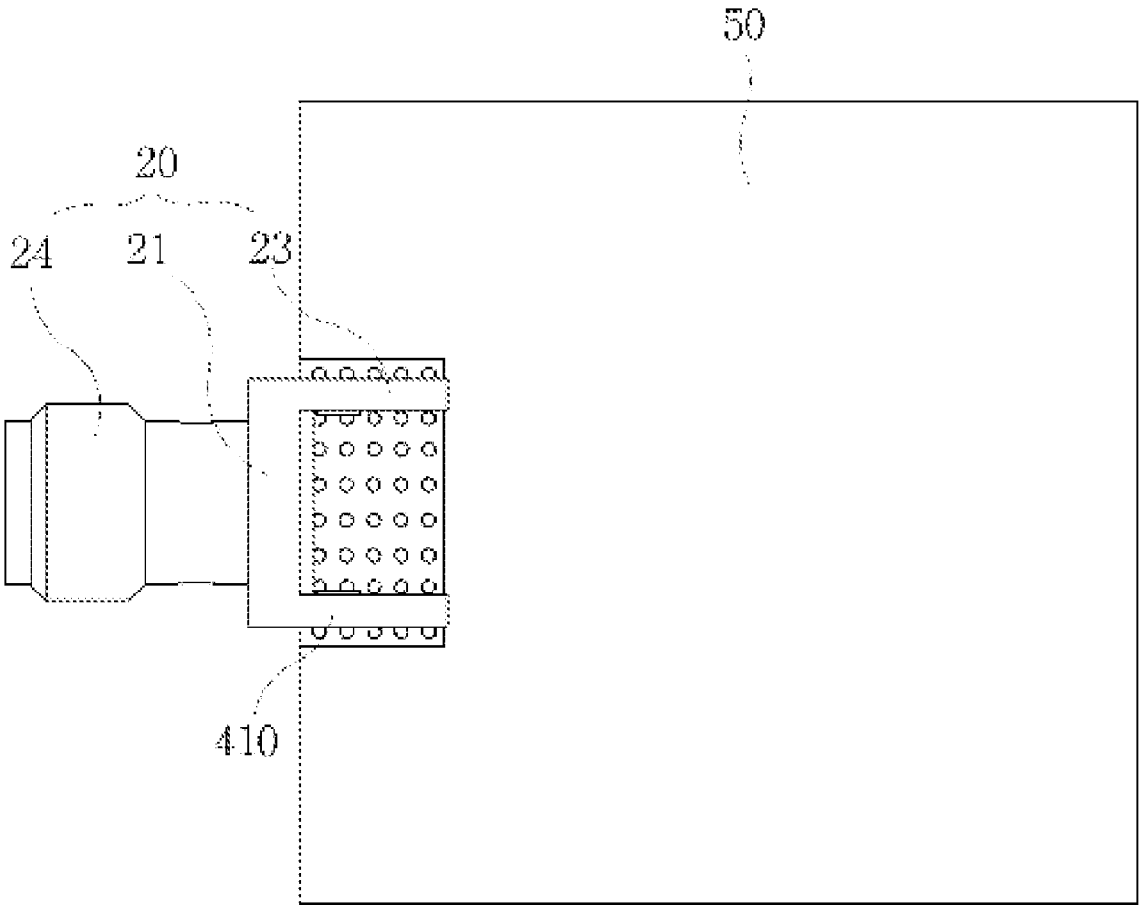
FIG. 37 is a bottom view of the high-frequency connector module shown in FIG. 33.

FIG. 31 illustrates a perspective view of a grounding unit for a high-frequency connector according to Embodiment 7. FIG. 32 illustrates a side view of the grounding unit shown in FIG. 31. FIG. 33 illustrates a perspective view of a high-frequency connector module employing the grounding unit shown in FIG. 31. FIG. 34 illustrates another perspective view of the high-frequency connector module employing the grounding unit shown in FIG. 31. FIG. 35 illustrates a plan view of the high-frequency connector module shown in FIG. 33. FIG. 36 illustrates a side view of the high-frequency connector module shown in FIG. 33. FIG. 37 illustrates a bottom view of the high-frequency connector module shown in FIG. 33.

Referring to FIGS. 31 and 32, the high-frequency connector 20 employing the grounding unit 400 according to Embodiment 7 may include, like in Embodiment 6, a connector body 21 having a connection unit 24, a pair of first grounding rods 22, each protruding from each lower side of the connector body 21, and a pair of second grounding rods 23, each protruding from each side of the connector body 21 in a manner that is disposed above the first grounding rod 22 at a predefined distance. Hence, a pair of the first grounding rods 22 and a pair of the second grounding rods 23 are spaced a predefined distance apart from each other.

A vertical length of the first grounding rod 22 may be elongated longer than a vertical length of the second grounding rod 23. This is to provide a region in the first grounding rod 22 to which the grounding unit 400 according to Embodiment 7 is fixed. The grounding unit 400 may include a grounding unit body which is fixed to a pair of the first grounding units 22 by supporting a surface of each first grounding rod 22 in close contact and a grounding fixation unit 430 which is formed on the grounding unit body and applies an elastic force to a printed circuit board (PCB) 50 that is inserted into a space between the first and second grounding rods 22 and 23.

The grounding unit body may be composed of a pair of engagement bodies 410 to be in contact with and support outer surfaces of the respective first grounding rods 22 that protrude from both lower sides of the high-frequency connector 20, and a connection body 420 connecting an upper portion of a pair of the engagement bodies 410.

In this case, each of the engagement bodies 410 may be formed to open a lower surface and either an inner or an outer side surface of each first grounding rod 22 to the outside. A pair of the engagement bodies 410 may be formed as side walls, each of which is in close contact with and support an inner wall of each first grounding rod 22. In this case, the side wall has an upper end connected to each end of the connection body 420 and is vertically bent from the connection body 420.

Accordingly, a pair of the side walls themselves may have a resilient elastic force of a certain magnitude. In addition, since a pair of the side walls are in close contact with the inner side walls of the respective first grounding rods 22, the first grounding rods 22 may be applied a certain amount of force, so that a pair of the engagement bodies 410 as side walls can be easily fixed to a pair of the first grounding rods 22.

Here, the grounding fixation unit 430 may include a first fixation body 431, a second fixation body 432, and a third fixation body 433. The first fixation body 431 linearly extends from both upper portions of a pair of the engagement bodies 410. The second fixation body 432 extends for a certain length and at an upward angle from an end of the first fixation body 431 in a manner that is spaced apart from a lower surface of the first grounding rod 22. The third fixation body 433 extends from an end of the second fixation body 432 at a downward angle along an opposite direction of the extension direction of the first fixation body 431.

In addition, the third fixation body 433 may be titled downward and stepwise. Moreover, the third fixation body 433 is substantially bent to be in close contact with a lower surface of the PCB 50.

An upper grounding region 51 formed on an upper surface of the PCB 50 may be in contact with lower surfaces of a pair of the second grounding rods 23 and a lower grounding region 52 formed on a lower surface of the PCB 50 may be in contact with a top surface of the third fixation body 433.

In this case, the PCB 50 which is inserted into a space between the lower surfaces of a pair of the first grounding rods 22 and the third fixation body 433 may be guided along a top surface of the second fixation body 432 which is inclined.

Additionally, the first fixation body 431 extends linearly from an upper end of each engagement body 410 and thus may allow the second and third fixation bodies 432 and 433 to be easily bent downward when a PCB 50 of a different thickness is inserted into the space. The first, second, and third fixation bodies 431, 432, and 433 may have a resilient elastic force to return an original state.

Accordingly, the lower grounding region 53 of the PCB 50 may be provided with an elastic force from the first fixation body 433 while being in contact with a top surface of the third fixation body 433. Moreover, the upper grounding region 51 of the PCB 50 may be in contact with the lower surfaces of a pair of the first grounding rods 22. Hence, the PCB 50 is enabled to be fixedly engaged in the space due to the elastic force of the third fixation body 433.

While the PCB 50 is being fixedly engaged in the space between the grounding fixation unit 430 and the second grounding rods 23, the upper grounding region 51 of the PCB 50 may be soldered to the first grounding rods 22 by a solder material. Thereafter, the solder material flows into the lower grounding region 52 through via-holes 51*a* which is formed on the upper grounding region 51 and solders the lower grounding region 52 to the third fixation body 433, thereby achieving soldering stability.

Furthermore, it is noted that a pair of the third fixation bodies 433 described in Embodiment 7 can support the lower grounding region 52 at a plurality of locations.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

What is claimed is:

1. A grounding unit for a high-frequency connector, comprising:

a grounding unit body configured to be selectively fixed to the high-frequency connector, wherein the grounding unit body comprises an engagement body engaged with a grounding rod extending from the high-frequency connector to be in electrical contact with the grounding rods, and a grounding fixation unit connected to the grounding unit body, wherein the grounding fixation unit is configured to be in contact with a grounding region of a printed circuit board (PCB) under elastic force applied in proportion to a thickness of the PCB to the grounding region, and wherein the grounding fixation unit is configured to electrically connect the high-frequency connector to the grounding region.

2. The grounding unit of claim 1, further comprising:

a pair of holes formed on both sides of the engagement body to expose the grounding rod.

3. The grounding unit of claim 2, wherein the engagement body has an upper portion divided into two segments in a longitudinal direction to be separatable from each other.

4. The grounding unit of claim 2, wherein the grounding fixation unit further comprises:

a first fixation body extending downward from a lower end of the engagement body;

a second fixation body bent from the first fixation body, wherein the second fixation body extends upward along a lower portion of the engagement body while maintaining a distance from a lower surface of the engagement body; and a third fixation body curved from an end of the second fixation body toward the lower surface of the engagement body, wherein the third fixation body has an end to be spaced apart from the lower surface of the engagement body and applies elastic force to the PCB to be in contact with the lower surface of the engagement body, wherein, when an upper grounding region is present on an upper surface of the PCB, the upper grounding region is in contact with the lower surface of the engagement body and a lower grounding region formed on a lower surface of the PCB is in contact with a top surface of the third fixation body.

5. The grounding unit of claim 4, wherein the first fixation body extends to form an obtuse angle with the lower surface of the engagement body.

6. The grounding unit of claim 5, wherein the high-frequency connector comprises a connector body on which at least one of the grounding rods is provided and a space portion in which the first fixation body can freely move.

7. A high-frequency connector module comprising:

a high-frequency connector;

a connection unit formed on the high-frequency connector, the connection unit configured to be electrically connected to a high-frequency module; and the grounding unit of claim 1.

* * * * *